US007437102B2

(12) United States Patent
Yamada et al.

(10) Patent No.: US 7,437,102 B2
(45) Date of Patent: Oct. 14, 2008

(54) IMAGE FORMING APPARATUS WITH CONTROLLED ADJUSTMENT OF TONER STORED IN DEVELOPING CARTRIDGE

(75) Inventors: Yoichi Yamada, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 200 days.

(21) Appl. No.: 11/081,017

(22) Filed: Mar. 15, 2005

(65) Prior Publication Data

US 2005/0207790 A1 Sep. 22, 2005

(30) Foreign Application Priority Data

Mar. 18, 2004 (JP) ..... P2004-078276
Mar. 18, 2004 (JP) ..... P2004-078277
Mar. 18, 2004 (JP) ..... P2004-078278

(51) Int. Cl.
*G03G 15/01* (2006.01)

(52) U.S. Cl. ..... 399/227; 399/27; 399/254; 399/302

(58) Field of Classification Search ..... 399/227
See application file for complete search history.

(56) References Cited

U.S. PATENT DOCUMENTS 7,065,304 B2 * 6/2006 Taguchi ..... 399/12
7,123,863 B2 * 10/2006 Yamada et al. ..... 399/227
7,177,556 B2 * 2/2007 Ishibashi et al. ..... 399/27
7,190,923 B2 * 3/2007 Yamada et al. ..... 399/227

FOREIGN PATENT DOCUMENTS

| | | |
|---|---|---|
| JP | 10-133451 | 5/1998 |
| JP | 10-186766 | 7/1998 |
| JP | 11-133819 | 5/1999 |
| JP | 2002-162810 | 6/2002 |
| JP | 2002-351188 | 12/2002 |
| JP | 2002-351190 | 12/2002 |
| JP | 2003-312102 | 11/2003 |
| JP | 2003-316106 | 11/2003 |

* cited by examiner

*Primary Examiner*—David M. Gray
*Assistant Examiner*—Ryan D Walsh
(74) *Attorney, Agent, or Firm*—Hogan & Hartson LLP

(57) ABSTRACT

An image forming apparatus includes development cartridges which develop an electrostatic latent image with toner, a rotary unit provided with the developing cartridges, an intermediate transfer belt which receives the toner image, and a controller. A length of the intermediate transfer belt is set such that a length of the image forming region is corresponded to a length of a set recording medium having a predetermined size and a length of the non-image forming region is corresponded to a distance between a rear end of the preceding one of the set recording mediums and the front end of the subsequent one. A rotational movement period of the intermediate transfer belt corresponding to the length of the non-image forming region is equal to or greater than a time required for switching the developing cartridges. The controller performs an switching operation of the developing cartridges in accordance with a size of a recording medium.

3 Claims, 12 Drawing Sheets

IMAGE FORMING APPARATUS WITH CONTROLLED ADJUSTMENT OF TONER STORED IN DEVELOPING CARTRIDGE

BACKGROUND OF THE INVENTION

The present invention relates to an image forming apparatus and, more particularly, to an image forming apparatus in which image formation is performed such that a toner image formed on a surface of a carrier is transferred to an intermediate transfer belt for transferring the toner image to recording medium.

Also, the present invention relates to an image forming apparatus and, more particularly, to an image forming apparatus that performs image formation while rotary revolving a plurality of developing cartridges.

Conventionally, there is known an image forming apparatus of electrophotographic recording mode that exposes and forms an electrostatic latent image on a surface of a carrier made of a photoreceptor. In this image forming apparatus, a toner image, which is obtained by toner developing the electrostatic latent image and carried on the carrier surface, is transferred to recording medium such as recording paper, thus providing image formation. This electrostatic latent image is toner developed such that a developing roller opposed to the carrier surface is rotated to transfer and affix, to the carrier surface, toner on the surface of the developing roller. This developing roller is supplied with toner as a supply roller rotating in a toner storing space rotates in press contact therewith.

As this image forming apparatuses adopting the electrophotographic recording mode, there is an apparatus configured capable of housing in a rotary unit a plurality of developing cartridges that each include a container for storing toner therein together with the developing roller opposed to the carrier and the supply roller. In this image forming apparatus, the developing cartridge can be switched to be set at a developing position opposed to the carrier by rotating the rotary unit about a rotational shaft.

Consequently, such an image forming apparatus is configured capable of housing in the rotary unit (attaching to the rotary unit) developing cartridges storing toners of yellow (Y), magenta (M), cyan (C), and black (K) as the developing cartridges for affixing toner to the carrier surface. Thereby, a color image obtained by overlapping the individual colors can be formed by sequentially switching the developing cartridges. With this configuration, it is possible to form a monochrome image formed with toners of a single color, e.g., a black-and-white monochrome image formed with the toner of black (K) (hereinafter also referred to simply as a monochrome image).

Besides, it is proposed that the image forming apparatus provided with the rotary unit capable of attaching thereto a plurality of developing cartridges which stores toners of the same color (mainly black). With this configuration, the rotary unit is rotated at each timing, such as of when toner runs out, to sequentially switch the developing cartridges to be put to use. This reduces the frequency of toner replenishing operations, thus making it possible to realize continuous formation of the monochrome image over a long period (e.g., see JP-A-2002-351190 and JP-A-2003-316106).

However, such an image forming apparatus of electrophotographic recording mode need maintain image quality by refreshing, such as agitating, the stored toner in the container. In contrast, to form a color image, the image forming apparatus including the rotary unit sequentially switches the developing cartridges to be opposed to the carrier. Therefore, the developing cartridges are inverted upside down with the rotation of the rotary unit for performing this developing cartridge switching operation. Thereby, toners in the container are once mixed together to appropriately refresh the stored toner, thus making it possible to maintain image quality (e.g., see JP-A-2002-351190).

However, to form a monochrome image, the same developing cartridge is continuously used. Therefore, to perform an image forming operation (developing operation) in succession, there is a need to provide an agitating (adjusting) member and refreshing the stored toner during the operation.

Besides, as the image forming apparatus provided with the rotary unit, there is an apparatus contrived as follows. That is, a partition plate for partitioning off a small space in which the supply roller rotates is provided in the developing cartridge (container). And, the stored toner is appropriately replenished (adjusted) into the space in which the supply roller operates, thereby preventing toner to be supplied to the developing roller from accumulating around the supply roller over a long period, thus maintaining image quality with higher reliability. Even with this configuration, to form a color image, the developing cartridge is inverted upside down with the rotation of the rotary unit during the developing cartridge switching operation, thereby enabling appropriate replenishment of the stored toner to the space in which the supply roller operates (e.g., see JP-A-2002-351190).

However, similarly, to form a monochrome image, the same developing cartridge is continuously used. Therefore, to perform the image forming operation (developing operation) in succession, there is a need to provide a replenishing member which replenishes the stored toner to the supply roller side during the operation.

Further, the following can be considered as the adjusting member of agitating and replenishing the stored toner in the developing cartridge for forming a monochrome image. That is, at the timing of when there arises a need to adjust the stored toner, for example, when a pre-set amount of image formation is provided, as with color image formation, the stored toner is appropriately adjusted by rotating the rotary unit to invert the developing cartridge upside down.

However, when the same developing cartridge is continuously used to form a monochrome image, the stored toner in the developing cartridge is adjusted by rotating the rotary unit, which thus interrupts image formation during this stored toner adjusting operation. A predetermined amount of image formation is pre-set as a criterion for determining whether a stored toner adjusting timing is reached or not, in which state this stored toner adjusting operation need be repeatedly performed each time this amount of image formation is reached.

Since this criterion of determination as to whether or not to perform the stored toner adjusting operation is normally set to make allowance, this adjusting operation is sometimes carried out although allowance still remains before the actual timing of requiring adjustment of the stored toner. For example, even when an image data recording, and forming process is ready to be completed with image formation on one more recording medium, the image formation is interrupted and the stored toner adjusting operation is forcibly carried out. Consequently, there is the problem of reducing an image forming speed at which to complete recording and forming of image data, i.e. a so-called throughput.

Further, as the adjusting member of agitating and replenishing the stored toner in the developing cartridge for forming a monochrome image, as with color image formation, it can be considered that the stored toner is appropriately adjusted by rotating the rotary unit to invert the developing cartridge upside down.

However, to form a monochrome image, when the stored toner in the developing cartridge is adjusted by rotating the rotary unit, under a normal image forming control, image formation is interrupted during this stored toner adjusting operation. This reduces an image forming speed at which to complete the recording and forming of image data, i.e., a so-called throughput.

Furthermore, as such an image forming apparatus of electrophotographic recording mode, there is an apparatus configured as follows. That is, the toner image obtained by developing the electrostatic latent image on the carrier surface is once delivered to an intermediate transfer belt before being transferred to the recording medium. Thus, a toner image such as a color image is formed on this intermediate transfer belt and thereafter is transferred to the recording medium to provide image formation (e.g., see JP-A-2002-351190).

In this image forming apparatus provided with the intermediate transfer belt, the intermediate transfer belt rotates endlessly in accordance with the transport of the recording medium and the rotation of the carrier (toner image), whereby the toner image on the carrier surface is received by the intermediate transfer belt and then is transferred therefrom to the recording medium, thus providing image formation. However, to form a color image, there is a need to switch the developing cartridge in the course of the rotation of the intermediate transfer belt. Consequently, this intermediate transfer belt is formed longer than the transport-direction (sub-scan direction) length of the recording medium (toner image) designed capable of forming the color image thereon, by at least an amount capable of securing the switching operation period of the aforesaid developing cartridge.

However, to form a monochrome image, there is no need to switch the developing cartridges. Therefore, a region of the intermediate transfer belt for securing the developing cartridge switching operation period is not necessary in carrying out a normal operation.

Here, for example, A4 size recording paper (recording medium) is in general use in Japan, while recording paper of slightly larger size than A4 size, i.e. of legal size is also often used in foreign countries. Consequently, it is convenient if even a color image forming apparatus for A4 size use can be used to form a monochrome image such as a text on the recording paper of legal size.

SUMMARY OF THE INVENTION

It is therefore an object of the present invention to provide an image forming apparatus, in which the timing of carrying out an adjusting operation such as of agitating and replenishing toner stored in developing cartridges is controlled so as to avoid forcible start of the adjusting operation, thus enabling an improvement in so-called throughput.

Further, an another object of the invention is to provide an image forming apparatus in which efficient image formation is realized by effectively utilizing the length of an intermediate transfer belt and by controlling the timing of adjusting stored toner so as to be able to successively provide image formation, thus enabling an improvement in so-called throughput.

Finally, an another object of the invention is to provide an image forming apparatus that is improved in usability by being configured such that the length of an intermediate transfer belt is effectively utilized to be able to meet demands on the size of recording paper capable of image formation.

In order to achieve the above object, according to the present invention, there is provided an image forming apparatus, comprising:

a carrier on which an electrostatic latent image is formed;

a plurality of development cartridges which develop the electrostatic latent image with toner to form a toner image, and which store the same color toners;

a rotary unit on which the developing cartridges are mounted around a rotational shaft of the rotary unit, and which rotates the developing cartridges about the rotational shaft so as to oppose any of the developing cartridges to the carrier;

an intermediate transfer belt which receives the toner image formed on the carrier and which moves rotationally to transfer the toner image to a recording medium; and a controller which controls a rotation of the rotary unit for switching the developing cartridges and a driving of the developing cartridges to form the toner image, wherein the intermediate transfer belt has an image forming region and a non-image forming region;

wherein a length of the intermediate transfer belt is set such that a length of the image forming region is corresponded to a length of a set recording medium having a predetermined size and a length of the non-image forming region is corresponded to a distance between a rear end of the preceding one of the set recording mediums and the front end of the subsequent one in the transferring process of the toner image to the recording medium;

wherein a rotational movement period of the intermediate transfer belt corresponding to the length of the non-image forming region is equal to or greater than a time required for switching the developing cartridges; and wherein the controller performs an switching operation of the developing cartridges in accordance with a size of a recording medium for performing an image formation.

In this invention, whether or not to carry out the developing cartridge switching operation is made to correspond to the size of the recording medium, whereby the developing cartridge switching operation is carried out in response to the size of the recording medium to which to provide image formation. Accordingly, the developing cartridges can be switched within reason, so that the desired image can be agreeably formed on the recording medium.

Preferably, the controller consecutively forms an image by switching the developing cartridges for each rotation of the intermediate transfer belt when the size of the recording medium for performing the image formation is equal to or smaller than the set recording medium.

In this invention, to process the recording medium of set size, the intermediate transfer belt can secure a region thereof for the developing cartridge switching operation period. Thus, image formation can be provided while switching the developing cartridges during the period between the preceding and subsequent recording medium for each rotation of the intermediate transfer belt (after development transfer). Accordingly, it is possible to provide image formation by frequently switching the plurality of developing cartridges.

Preferably, the controller consecutively forms an image without switching the developing cartridges when the size of the recording medium for performing the image formation is greater than the set recording medium.

In this invention, to process the recording medium that exceeds the set size, the intermediate transfer belt cannot secure the region thereof for the developing cartridge switching operation period. Thus, image formation is provided without switching the developing cartridges during the period between the preceding and subsequent recording medium. Accordingly, it is possible to provide image formation, with a toner image held even in the region of the intermediate transfer belt for securing the developing cartridge switching operation period.

According to the present invention, there is also provided an image forming apparatus, comprising:

a carrier on which an electrostatic latent image is formed;

a plurality of development cartridges which develop the electrostatic latent image with toner to form a toner image, and which store different color toners for forming a color image, a multicolor image, or a monochrome image;

a rotary unit on which the developing cartridges are mounted around a rotational shaft of the rotary unit, and which rotates the developing cartridges about the rotational shaft so as to oppose any of the developing cartridges to the carrier;

an intermediate transfer belt which receives the toner image formed on the carrier and which moves rotationally to transfer the toner image to a recording medium; and a controller which controls a rotation of the rotary unit for switching the developing cartridges and a driving of the developing cartridges to form the toner image, wherein the intermediate transfer belt has an image forming region and a non-image forming region;

wherein a length of the intermediate transfer belt is set such that a length of the image forming region is corresponded to a length of a set recording medium having a predetermined size and a length of the non-image forming region is corresponded to a distance between a rear end of the preceding one of the set recording mediums and the front end of the subsequent one in the transferring process of the toner image to the recording medium;

wherein a rotational movement period of the intermediate transfer belt corresponding to the length of the non-image forming region is equal to or greater than a time required for switching the developing cartridges; and wherein the controller performs an image formation on a recording medium of a size which is greater than the set recording medium of the size in a monochrome image operation without switching the developing cartridges.

Preferably, when the image formation on the recording medium of the size which is greater than the set recording medium of the size in the monochrome image operation is performed, the non-image forming region of the intermediate transfer belt receives the toner image for transferring to the recording medium.

In this invention, the developing cartridges need be switched in order to form the color image, while the developing cartridges need not necessarily be switched in order to form the monochrome image. Therefore, this permits the process of forming the monochrome image on larger recording medium than the recording medium of set size capable of forming the color image thereon. Consequently, it is possible to provide image formation, with a toner image held even in the region of the intermediate transfer belt for securing the developing cartridge switching operation period, without switching the developing cartridge during the period between the preceding and subsequent recording medium. Accordingly, it is possible to form a slightly larger monochrome image than the color image.

Preferably, the controller adjusts the toner stored for successively forming the image so as to invert the developing cartridges upside down in accordance with the rotation of the rotary unit.

In this invention, the developing cartridges are inverted upside down with the rotation of the rotary unit for switching the developing cartridges, thus performing the stored toner adjusting operation. Accordingly, image formation can be provided without particularly providing any member for adjusting the stored toner. Here, to process recording paper that exceeds the set size, this stored toner adjusting operation need only be performed after performing a pre-set amount of image formation.

According to the invention, when the developing cartridges can be switched during the period between the preceding and subsequent recording medium because the recording medium are of set size or smaller, it is possible to provide image formation while switching the developing cartridges. On the contrary, even when the developing cartridges cannot be switched during the period between the preceding and subsequent recording medium because the recording medium exceed the set size, image information can be provided by permitting formation of a toner image, without switching the developing cartridges, within the region of the intermediate transfer belt for switching the developing cartridges.

Accordingly, it is possible to provide image formation by effectively utilize the length of the intermediate transfer belt. Thus, a reduction in size can be realized while fulfilling demands on the size of the recording medium to which to provide image formation to the maximum extent possible and while maintaining an image formation speed (so-called throughput) and image quality. For example, when the apparatus includes the function of forming a color image by attaching thereto and sequentially switch developing cartridges storing toner for color image use, the color image can make it possible to form the desired monochrome image on recording medium of the size that cannot allow for formation of the monochrome image.

Furthermore, the stored toner adjusting operation is performed by performing this developing cartridge switching operation, which can omit the member for adjusting the stored toner so as to allow successive image formation, thus enabling a reduction in size and cost.

According to the present invention, there is also provided aAn image forming apparatus, comprising:

a carrier on which an electrostatic latent image is formed;

a plurality of development cartridges which develop the electrostatic latent image with toner to form a toner image;

a rotary unit on which the developing cartridges are mounted around a rotational shaft of the rotary unit, and which rotates the developing cartridges about the rotational shaft so as to oppose any of the developing cartridges to the carrier; and a controller which controls a rotation of the rotary unit for switching the developing cartridges and a driving of the developing cartridges to form the toner image, wherein the controller adjusts the toner stored in the developing cartridge for successively forming the image so as to invert the developing cartridges upside down by rotating the rotary unit based on image forming job information for executing an image formation.

In this invention, the timing of starting the stored toner adjusting operation not from an image forming job processed but from an image forming job to be processed is determined. Accordingly, the operation of adjusting the stored toner in the developing cartridges is not forcibly started regardless of the image forming job to be carried out, which makes it possible to avoid an image forming operation from being interrupted without reason.

Preferably, the image forming job information includes a consumption amount of the toner stored in the developing cartridge which is positioned at a developing position opposed to the carrier. A margin consumption amount and a limit consumption amount are set. The limit consumption amount indicates that a toner amount stored in the developing cartridge is near end amount. The margin consumption amount indicates that the toner amount stored in the developing cartridge is a toner amount in which a little margin toner amount is added to the limit consumption amount. When a job toner consumption amount required to execute the image forming job is smaller than the limit consumption amount even when the job toner consumption amount exceeds the margin consumption amount, the controller completes the image forming job without performing an operation of adjusting the toner stored in the developing cartridge.

In this invention, once an image forming job is carried out, the operation of adjusting the stored toner in the developing cartridge is normally started each time the consumption information of the stored toner in the in-use developing cartridge positioned at the developing position reaches the margin consumption. However, when an amount of stored toner necessary to complete the image forming job is smaller than or equal to the limit consumption, the operation of adjusting this stored toner is omitted. Accordingly, it is possible to avoid the image forming operation from being interrupted at the timing of when the image forming job is to be completed in a little while. When the consumption information of the stored toner necessary for this image forming job can be divided into pieces smaller than or equal to the limit consumption, the frequency of interruptions of the image forming operation can also be reduced.

Preferably, the development cartridges storing different color toners for forming a color image, a multicolor image, or a monochrome image are mounted on the rotary unit. The controller rotates the rotary unit for one revolution to perform the operation of adjusting the toner stored in the developing cartridge in the monochrome image formation.

In this invention, to form a monochrome image in succession without rotating the rotary unit although the image forming apparatus includes the function of forming a color image, the operation of adjusting the stored toner in the developing cartridge in use is started in conformity to the image forming job for the monochrome image. Accordingly, this prevents the problem that one rotation of the rotary unit necessary for this stored toner adjusting operation is performed without reason to interrupt the image forming operation in an undesirable manner.

Preferably, the development cartridges storing the same color toners for forming a monochrome image are mounted on the rotary unit. The controller performs the operation of adjusting the toner stored in the developing cartridge to be used in successively forming the monochrome image without rotating the rotary unit, by rotating the rotary unit through an angle equal to or greater than an angle required to switch from the developing cartridge positioned at a developing position opposed to the carrier to another developing cartridge adjacent thereto.

In this invention, to utilize the image forming apparatus as an apparatus for exclusive use in forming a monochrome image, when the monochrome image is successively formed without rotating the rotary unit, the operation of adjusting the stored toner in the developing cartridge in use is started in conformity to the image forming job for the monochrome image. Accordingly, this prevents the problem that the developing cartridge switching operation necessary for this stored toner adjusting operation is performed without reason to interrupt the image forming operation in an undesirable manner.

According to the invention, the timing of starting the operation of adjusting the stored toner in the developing cartridge in use is determined in response to a consumption, for example of the stored toner, necessary for an image forming job to be processed. Therefore, normally, the stored toner adjusting operation is started at an early timing, while when an image forming job can be completed before the need for the adjusting operation, the stored toner adjusting operation is omitted. Accordingly, the timing of adjusting the stored toner in the developing cartridge is controlled so that it is possible to avoid the image forming operation from being forcibly interrupted regardless of the image forming job. As a result, it is possible to improve an image forming speed operating until the image forming job is completed, i.e., a so-called throughput.

According to the present invention, there is also provided an image forming apparatus, comprising:

a carrier on which an electrostatic latent image is formed;

a plurality of development cartridges which develop the electrostatic latent image with toner to form a toner image;

a rotary unit on which the developing cartridges are mounted around a rotational shaft of the rotary unit, and which rotates the developing cartridges about the rotational shaft so as to oppose any of the developing cartridges to the carrier;

an intermediate transfer belt which receives the toner image formed on the carrier and which moves rotationally to transfer the toner image to a recording medium;

a transporting member which transports the recording medium to a transfer position for transferring the toner image to the recording medium; and a controller which controls operations of the carrier, the rotary unit, the development cartridges, the intermediate transfer belt and the transporting member, wherein the intermediate transfer belt has an image forming region and a non-image forming region;

wherein a length of the intermediate transfer belt is set such that a length of the image forming region is corresponded to a length of a set recording medium having a predetermined size and a length of the non-image forming region is corresponded to a distance between a rear end of the preceding one of the set recording mediums and the front end of the subsequent one in the transferring process of the toner image to the recording medium;

wherein a rotational movement period of the intermediate transfer belt corresponding to the length of the non-image forming region is equal to or greater than a time required for switching the developing cartridges; and wherein the controller controls a forming position of the toner image for transfer to the intermediate transfer belt and a timing of rotating the rotary unit, based on image forming job information for executing an image formation.

In this invention, as for the image forming job information to be executed, the toner image forming position on the intermediate transfer belt and the timing of rotating the rotary unit can be controlled into an optimum condition. Accordingly, image formation can be efficiently performed in such a manner as, for example, to form a toner image by performing the developing cartridge switching operation during the rotational movement period between recording medium on the intermediate transfer belt, or by performing the developing cartridge switching operation separately.

Preferably, the image forming job information is information regarding whether image data of the image forming job is a color image or a monochrome image.

In this invention, to form the color image, image formation need be provided while switching the developing cartridges during the rotational movement period between recording medium on the intermediate transfer belt. However, the switching of the developing cartridges is not indispensable to formation of the monochrome image. Consequently, the toner image forming position on the intermediate transfer belt and the timing of rotating the rotary unit can be controlled into an optimum condition according to whether the image forming job information is of a color image or a monochrome image.

Preferably, the image forming job information is information regarding a size and number of recording medium required to execute the image forming job information.

In this invention, in the case of forming a smaller toner image than the rotational movement period for developing cartridge switching use and the set size that are prepared on the intermediate transfer belt, or in like case, the necessity of the region in which to form no toner image can be selected and controlled in response to the size and number of recording medium.

Preferably, the intermediate transfer belt receives the toner images at all around surface of the intermediate transfer belt. The controller controls so that at least a timing of forming the electrostatic latent image on the carrier and a timing of transporting the recording medium by the transporting member are matched with each other at the transfer position on the intermediate transfer belt.

In this invention, in the case of controlling the toner image forming position (carrying position) on the intermediate transfer belt, a position at which to form a toner on the carrier, that is, a position at which to form an electrostatic latent image, in other words, the timing of forming the electrostatic latent image is matched with the toner image forming position. And, the timing of transporting the recording medium to their transfer position so that the toner image on the intermediate transfer belt can be transferred thereto is also matched with the toner image forming position. By so doing, image formation can be provided to the recording medium.

Preferably, the controller adjusts the toner stored in the developing cartridge for successively forming the image so as to invert the developing cartridges upside down in accordance with the rotation of the rotary unit.

In this invention, the rotational movement period between recording medium is prepared, on the intermediate transfer belt, for use in switching the developing cartridges by rotating the rotary unit. Thus, this configuration can be optimally applied to an image forming apparatus for adjusting the stored toner in synchronism with this developing cartridge switching operation.

Preferably, during the period in which an image formation based on the image forming job information is completed while using the same developing cartridge, the controller forms a toner image on the intermediate transfer belt so as to narrow the distance between the rear end of the preceding one of the recording mediums and the front end of the subsequent one, without switching the developing cartridge opposed to the carrier.

In this invention, a toner image obtained by successive development without switching the developing cartridges can be formed on the intermediate transfer belt. Thus, the rotational movement period between recording medium, which is prepared for developing cartridge switching use on the intermediate transfer belt, or the like is omitted, thereby making is possible to shorten a time required for image formation.

Preferably, the development cartridges storing different color toners for forming a color image, a multicolor image, or a monochrome image are mounted on the rotary unit by switching the developing cartridge positioned at a developing position. The controller performs the operation of adjusting the toner stored in the developing cartridge in the monochrome image formation, by rotating the rotary unit for one revolution.

This invention is applicable to an image forming apparatus including the function of forming a color image. Particularly, in the case of successively forming a monochrome image without rotating the rotary unit, the toner image forming position on the intermediate transfer belt and the timing of rotating the rotary unit are controlled into an optimum condition in conformity to the image forming job information of the monochrome image.

Preferably, the development cartridges storing the same color toners for forming a monochrome image are mounted on the rotary unit. The controller performs the operation of adjusting the toner stored in the developing cartridge to be used in forming the monochrome image without rotating the rotary unit, by rotating the rotary unit through an angle equal to or greater than an angle required to switch from the developing cartridge positioned at a developing position opposed to the carrier to another developing cartridge adjacent thereto.

This invention is applicable to an image forming apparatus utilized as an apparatus for exclusive use in forming a monochrome image. And, in this invention, the toner image forming position on the intermediate transfer belt and the timing of rotating the rotary unit are controlled into an optimum condition in conformity to the image forming job information of the monochrome image.

According to the invention, the rotational movement period between recording medium for performing the developing cartridge switching operation by rotating the rotary unit, or the like is omitted. Thereby, the length of the intermediate transfer belt can be effectively utilized in response to image forming job information to be executed, for example, the kind of images and the size and number of recording medium, thus enabling efficient image formation. Accordingly, it is possible to improve a speed at which to complete image formation (so-called throughput).

BRIEF DESCRIPTION OF THE DRAWINGS

The above objects and advantages of the present invention will become more apparent by describing in detail preferred exemplary embodiments thereof with reference to the accompanying drawings, wherein:

FIGS. 4A and 4B are views showing a toner image on an intermediate transfer belt according to the first embodiment, in which FIG. 4A is a developed plan view showing a toner image when a developing cartridge switching period is secured according to the first embodiment and FIG. 4B is a developed plan view showing a toner image when the developing cartridges are unswitchable according to the first embodiment;

DETAILED DESCRIPTION OF THE PREFERRED EMBODIMENTS

Most preferred embodiments of the invention will hereinafter be described with reference to the drawings. FIGS. 1 to 5 show a first embodiment of the image formation apparatus according to the invention.

Figure 1:
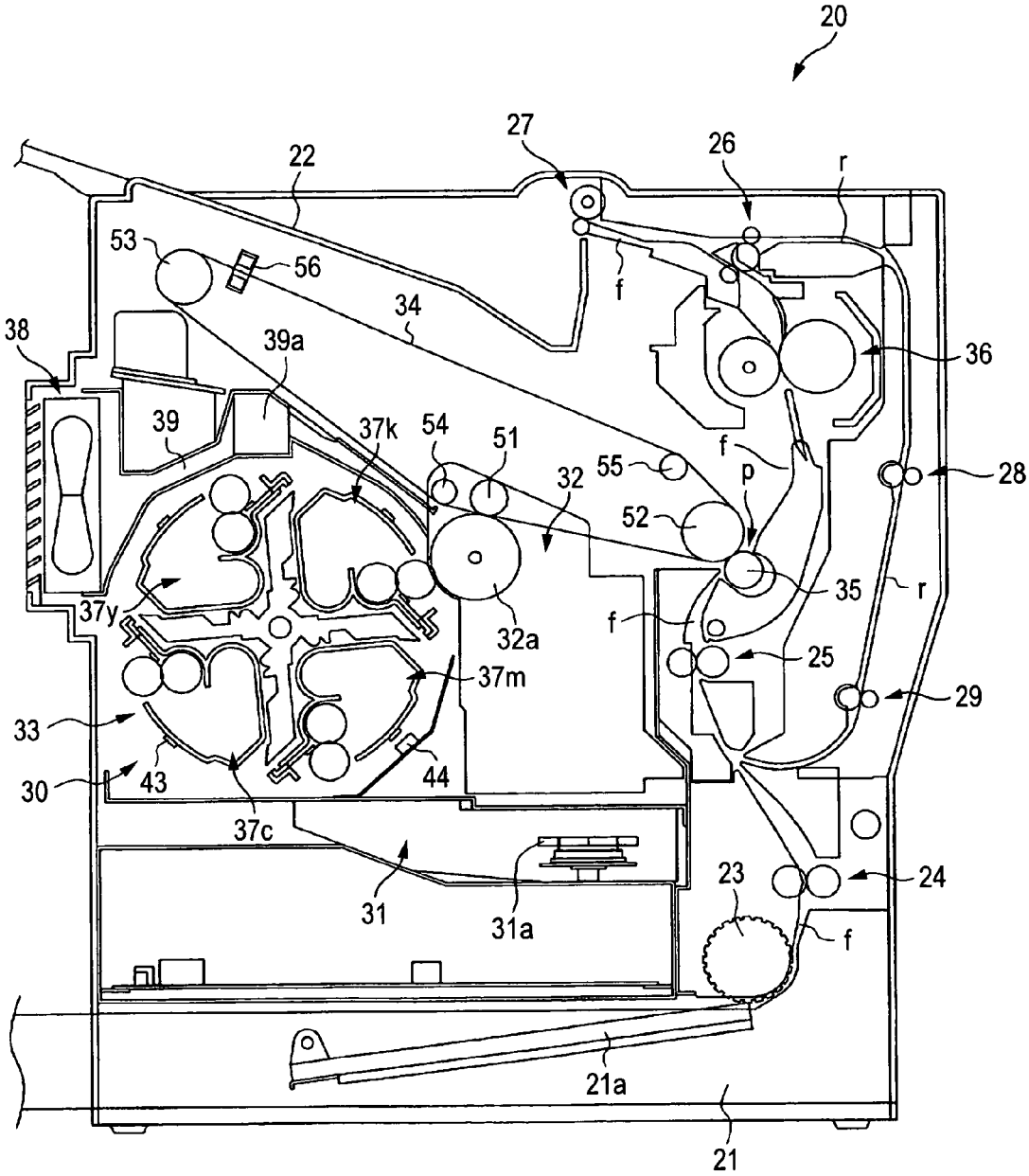
FIG. 1 is a view showing a perspective front view of the schematic overall configuration of an image forming apparatus according to a first embodiment of the invention.
Figure 2:
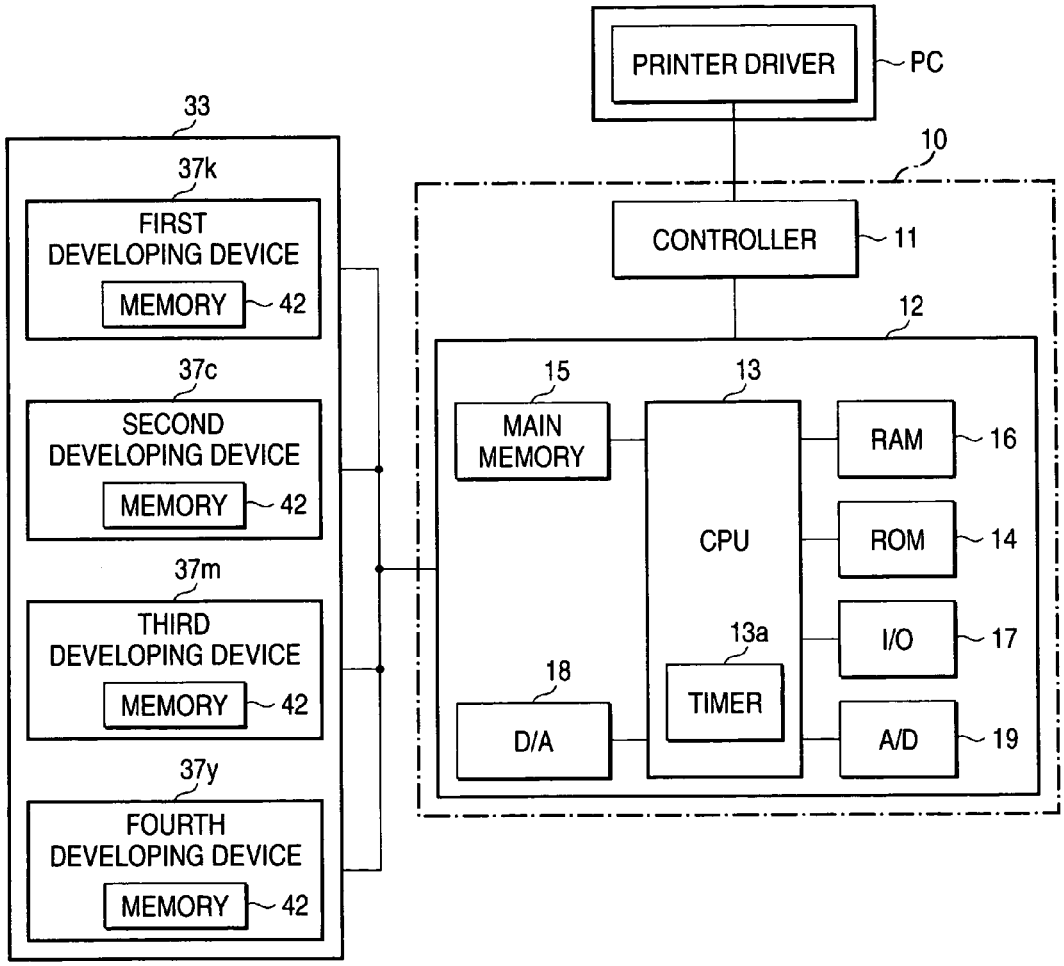
FIG. 2 is a relationship block diagram illustrating driving control according to the first embodiment.

In FIGS. 1 and 2, the image formation apparatus is utilized by being connected to a personal computer PC, for example, for creating and outputting an image such as a character, wherein a control unit 10 connected to the personal computer PC controls a paper transport device 20 and an image recording device 30, thereby forming and printing out an image on recording paper (recording medium).

The control unit 10 comprises a controller 11 and an engine controller 12 that are constructed on a circuit board mounted in an apparatus body. These controllers carry out various data processing controls and driving control of individual apparatus sections in accordance with pre-prepared programs.

To simply describe, a not-shown CPU carries out various processing procedures in accordance with processing programs stored in memories, whereby the controller 11 exchanges a variety of information, such as an instruction to print, with a printer driver of the personal computer PC. And, the controller 11 also receives therefrom image data of a text, etc. to be formed into an image such as by printing on recording paper and temporarily stores the image data in a not-shown memory. Since the image data (image information signals) received from the personal computer PC are so-called RGB data of red (R), green (G), and blue (B), this controller 11 reads these data from within the memories while converting them into printable image data, i.e., so-called YMCK data of yellow (Y), magenta (M), cyan (C), and black (K), and then delivers the printable image data to the engine controller 12.

In accordance with a control program stored in a ROM 14, a CPU 13 receives image data on a per page basis, for example, from the controller 11 and temporarily stores the image data in a main memory 15, and it also exchanges a variety of information with the paper transport device 20 and image recording device 30 while using a RAM 16 as a work area. Thereby, an image based is formed on this image data on recording paper. Besides, on this occasion, the CPU 13, when carrying out this image forming control, causes a built-in timer function (timing unit) 13*a* to time various processing time periods, etc. and thereby the individual apparatus sections to operate in an optimum condition.

In FIG. 2, an I/O interface 17 provides a connection between the paper transport device 20 and image recording device 30 and the engine controller 12 so that they can exchange a variety of information with each other. A D/A converter 18 and an A/D converter 19 convert digital signals to analog signals and vice versa so that the engine controller 12 can process the variety of information exchanged between the controller 11 and the paper transport device 20 and image recording device 30.

The paper transport device 20 includes a paper cassette 21, a paper discharge table 22, a pick-up roller 23, a transport roller pair 24, a resist roller pair 25, a switch roller pair 26, a paper discharge roller pair 27, and inverting roller pairs 28 and 29 and, in addition, of an intermediate transfer belt 34, a transfer roller 35, and a fixing roller pair 36 that are also the components of the image recording device 30. This paper transport device 20 separates a plurality of recording papers stacked in the paper cassette 21 one from another and transports and feeds them one by one to an image recording and forming position P of the image recording device 30. Thereby, the image recording device 30 records and forms received image data of a letter, etc. on one or both sides of each of the fed recording papers and, thereafter, the paper transport device 20 transports to the outside thereof the recording papers provided with image information and then stacks them onto the paper discharge table 22.

To simply describe, the pick-up roller 23 rotates in press contact with recording papers stacked on a lifting plate 21*a* in the paper cassette 21 and thereby draws out and separates them one from another in cooperation with not-shown separating unit, thus feeding each separated recording paper to a transport path f. The transport roller pair 24 transport the fed recording paper, while nipping it therebetween, to abut the leading end thereof against the nip portion of the downstream resist roller pair 25, thereby correcting the skew of the recording paper. The resist roller pair 25 feed the skew-corrected recording paper, while nipping it therebetween, to the image recording and forming position P in synchronism with the operation of the image recording device 30.

At this image recording and forming position P, the intermediate transfer belt 34 and transfer roller 35 transport the fed recording paper as they rotate while nipping it therebetween, thus recording and forming an image on one side of the recording paper being thus transferred. Besides, the fixing roller pair 36 transport the recording paper further downstream as they rotate while nipping it therebetween, thus fixing the image onto the recording paper being thus transferred.

Thereafter, the switch roller pair 26 and paper discharge roller pair 27 discharge and stack the recording paper from the fixing roller pair 36 onto the paper discharge table 22. Thereby, the recording paper is fed to the image recording device 30's image recording and forming position P with one side thereof serving as an image recording and forming side, is provided with image formation on the one side, and thereafter is discharged onto the paper discharge table 22.

On this occasion, the paper transport device 20 operates as follows when the engine controller 12 is instructed to carry out a both-side mode for providing image formation to both sides of recording paper. That is, the paper discharge roller pair 27 stop temporarily in a position where they nip therebetween the trailing end of the recording paper discharged onto the paper discharge table 22. Thereafter, the paper discharge pair 27 are driven in reverse rotation, together with the switch roller pair 26, to thereby send to an inverting path r the recording paper having the image recorded and formed on the one side thereof.

Thereafter, the inverting roller pairs 28 and 29 insert and transport the recording paper into the inverting path r while nipping it therebetween. Thereby, the recording paper is inverted so that the trailing end side thereof used upon one-side image formation serves as the leading end side thereof. Thus, the inverting roller pairs 28 and 29 feed the so-inverted recording paper again to the transport path f and then deliver it to the resist roller pair 25. Thereby, the recording paper is fed again to the image recording device 30's image recording and forming position P with the other side thereof (one side having no image recorded or formed thereon) serving as an image recording and forming side, thus providing the other side with image formation. Thereafter, the recording paper provided with image formation on both sides thereof is discharged onto the paper discharge table 22.

On the other hand, the image recording device 30 includes an exposure unit 31, a photoreceptor cartridge 32, a developing rotary unit 33, the intermediate transfer belt 34, the transfer roller 35, and the fixing roller pair 36. This image recording device 30 records and forms received image data of a character, etc., by xerography, on one or both sides of recording paper that has been transported and fed to the image recording and forming position P by the paper transport device 20.

To simply describe, the exposure unit 31 carries out an exposure scan by selectively irradiating with laser beams a surface of a photoreceptor drum 32*a* in the photoreceptor cartridge 32, based on image data received by a built-in laser beam scan device (polygon mirror) 31*a*. Thereby, an electrostatic latent image based on the image data is formed (created) on the surface of the photoreceptor drum 32*a*. The developing rotary unit 33 houses therein developing cartridges (illustrated as 37*y*, 37*m*, 37*c*, and 37*k* in the figures), one for each color, for developing this electrostatic latent image on the photoreceptor drum 32*a* with toners of yellow (Y), cyan (C), magenta (M), and black (K). Any of the developing cartridges 37 corresponding to image data for forming an electrostatic latent image is opposed to the photoreceptor drum 32*a* and the toner stored in the any of the developing cartridges 37 is thus affixed to the photoreceptor drum 32*a*, thereby toner developing the electrostatic latent image.

In the case of a monochrome image for example, the intermediate transfer belt 34 receives a toner image formed on the photoreceptor drum 32*a* with the toner of black (K) and holds on its belt surface a toner image to be transferred onto the recording paper. Besides, in the case of a color image, this intermediate transfer belt 34 receives toner images, which are formed on the photoreceptor drum 32*a* with the toners of yellow (Y), cyan (C), and magenta (M), in sequence (which sequence is not limited to the color sequence named) so that the toner images are superimposed one on another. And, the intermediate transfer belt 34 forms and carries on its belt surface a color toner image to be transferred to the recording paper. The transfer roller 35 transports the fed recording paper to the position (image recording and forming position P) between itself and this intermediate transfer belt 34 while nipping it therebetween, thereby transferring the toner image to the recording paper. Needless to say, the toners transfer to the recording paper from the developing cartridges 37 via the photoreceptor drum 32*a* and intermediate transfer belt 34 in accordance with a bias voltage between the members.

The fixing roller pair 36 heat press therebetween the recording paper that has the toner image transferred thereto and has been transported from the image recording and forming position P, thereby fixing the toner image to the recording paper, and also transport this recording paper further downstream while nipping it therebetween. Thereby, the monochrome or color image based on the received image data is recorded and formed (fixed) on one or both sides of the recording paper. Such an operation is repeated, whereby the image can be recorded and formed in succession on a plurality of recording papers.

In the photoreceptor drum 32*a*, residual toner remaining thereon after transferred to the intermediate transfer belt 34 is electrostatically discharged and collected by a not-shown cleaning device. Thereafter, an electrostatic charger electrostatically charges the collected toner to a potential such that the toner is received from the developing cartridges 37 of the developing rotary unit 33 by and affixed to the photoreceptor drum 32*a*. Besides, in the intermediate transfer belt 34, similarly, residual toner thereon is electrostatically discharged and charged, thus repeating the transfer (affixment) and collection of the toner. Furthermore, a suction fan 38 sucks the apparatus body side via an exhaust air duct 39, whereby toner scattering upon such toner collection is collected by a filter 39*a* attached to the exhaust air duct 39.

Figure 3:
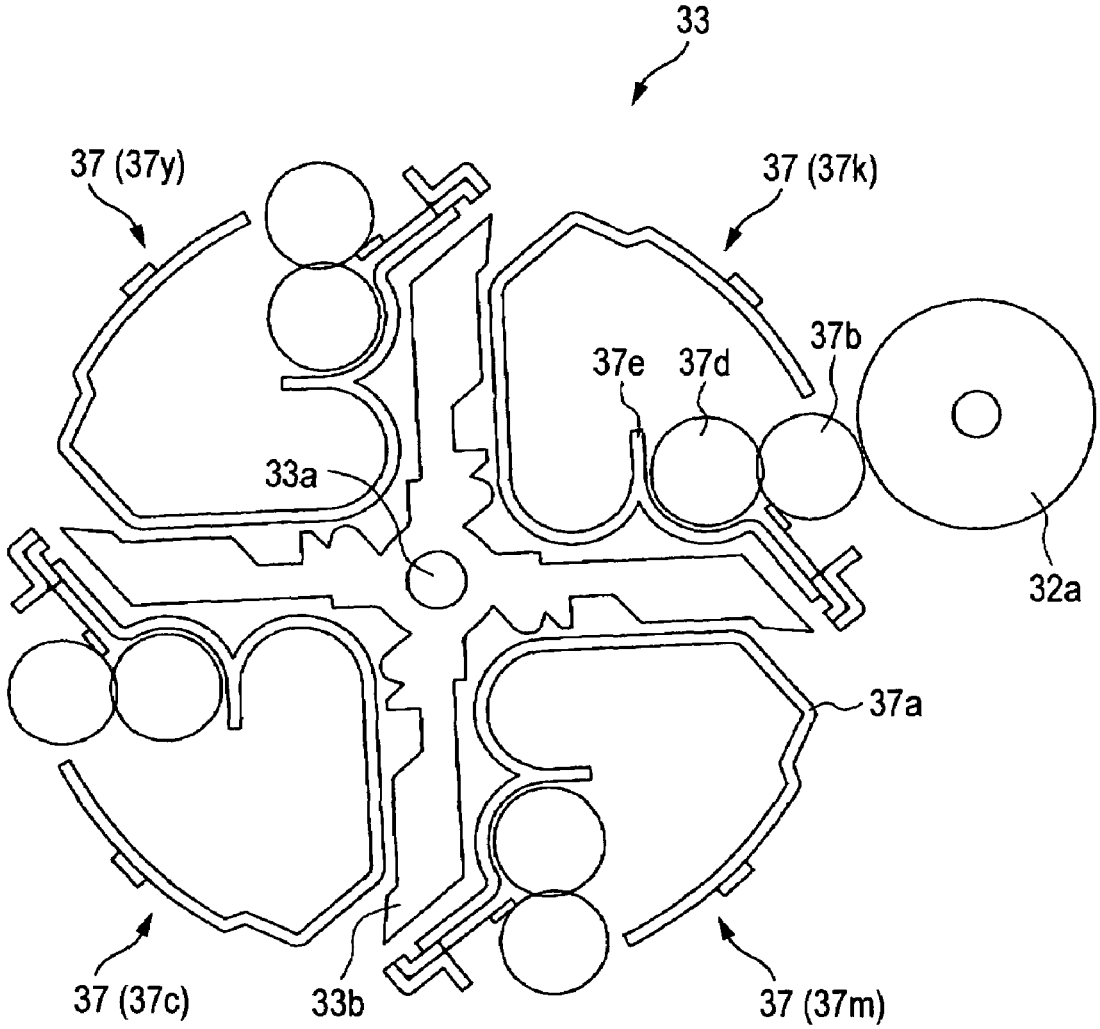
FIG. 3 is a perspective front view showing a developing rotary unit housing developing cartridges therein according to the first embodiment.

And, as shown in FIG. 3, the developing rotary unit 33 is configured such that a plurality of the developing cartridges 37 for toner developing an electrostatic latent image on the surface of the photoreceptor drum 32*a* are housed (attached) within respective housing positions defined by a defining frame 33*b* that rotates about a rotational shaft 33*a*. The CPU (controller) 13 of the engine controller 12 rotates this developing rotary unit 33 about the rotational shaft 33*a*, based on an instruction to print, inclusive of image data, received thereby from the personal computer PC via the controller 11. Thereby, the developing cartridges 37 are switched to be opposed to the photoreceptor drum 32*a*, thus developing a toner image to be transferred to and provided with image formation on one or both sides of the recording paper.

For example, this image forming apparatus has housed in the developing rotary unit 33 thereof the developing cartridges 37*y*, 37*m*, 37*c*, and 37*k* for storing the color toners of yellow (Y), cyan (C), magenta (M), and black (K). And, this developing rotary unit 33 is rotated to switch the developing cartridges 37, which develop an electrostatic latent image on the photoreceptor drum 32*a*, so as to overlap the individual color toners stored therein for creating an intermediate color or to select any of them. Thereby, the image forming apparatus can be utilized as an apparatus capable of forming images ranging from a color image to a monochrome image.

Besides, this image forming apparatus is configured capable of image formation even when all the developing cartridges 37 having the same color toners stored therein are housed in the developing rotary unit 33. It is possible to attach thereto, for example, four developing cartridges 37*k* storing therein the same color toners of black (K). In this case, the image forming apparatus can be utilized as an apparatus for exclusive use in forming a monochrome image by rotating the developing rotary unit 33 to sequentially switch the developing cartridges 37*k* for developing an electrostatic latent image on the photoreceptor drum 32*a*, at an appropriate timing, for example, such as of when toner runs out. For example, an image forming operation can be carried out by appropriately switching the developing cartridges 37*k* in response to the received image data. For example, an image forming operation can be carried out by appropriately switch the developing cartridges 37*k* in response to the received image data.

Particularly, the developing cartridges 37 each include a container 37*a*, a developing roller 37*b*, a supply roller 37*d*, and a partition plate 37*e*. The containers 37*a* store toner therein, formed into a similar shape so as to be able to be housed in the respective housing spaces (positions) defined by the defining frame 33*b* of the developing rotary unit 33. The developing roller 37*b*, rotatably supported on an outer peripheral side of the container 37*a* spaced away from the rotational shaft 33*a* of the developing rotary unit 33, affixes toner, which is transferred from the supply roller 37*d*, to the photoreceptor drum 32*a* opposed to the developing roller 37*b*. The supply roller 37*d*, rotatably supported on the container 37*a* so as to adjoin the developing roller 37*b* on a side thereof opposite the rotational shaft 33*a* of the developing rotary unit 33, rotates in press contact with this developing roller 37*b* to thereby rub, electrostatically charge, and supply peripheral toner. The partition plate 37*d*, disposed so as to surround the supply roller 37*d*, partitions a toner storing space in the container 37*a* so as to provide communication between the rotation-direction upper portions of a rotational shaft 33*a* side space and a supply roller 37*d* placement space.

With this configuration, in the developing cartridge 37, the supply roller 37*d* supplies toner, which is in an outer peripheral side space of the container 37*a* partitioned by the partition plate 37*e*, to the developing roller 37*b* rotating in press contact with the supply roller 37*d*. Besides, in this developing cartridge 37, when the developing rotary unit 33 rotates 90° at one time and 180° in total in a counterclockwise direction as seen in FIG. 3, the stored toners on the rotational shift 33*a* side and supply roller 37*d* side of the container 37*a* are mixed together in the upper portion of the partition plate 37*e* (on the lower side of FIG. 3). Thereafter, the developing rotary unit 33 further rotates 90° at each time, whereby the stored toner in the container 37*a* is agitated for refreshment and the agitated toner is brought together to the supply roller 37*d* side so as to be able to be supplied to the developing roller 37*b*. That is, in the developing cartridge 37 attached to the thus-rotating developing rotary unit 33, the toner stored therein is replenished, while being agitated, to the supply roller 37*d* side by the rotation of the developing rotary unit 33. Therefore, it is possible to appropriately omit an adjusting device (so-called agitator device or auger device) for performing an adjusting operation such as of agitating and replenishing the stored toner. However, in this developing cartridge 37, to omit the adjusting device, as described later, the developing rotary unit 33 need be rotated to perform the toner replenishing and agitating operation when an amount of toner used exceeds a pre-set value at least before no more toner to be supplied to the developing roller 37*b* remains in the periphery of the supply roller 37*d*. The amount of toner used is detected based on, for example, a count value obtained from a counter, the number of dots in an image, a cumulative developing operation (image formation) time, the cumulative number of papers developed, or a measured amount of toner remaining.

Furthermore, the intermediate transfer belt 34 is formed into an endless belt that is trained over a first transfer pulley 51, a second transfer pulley 52, a driven pulley 53, and tension pulleys 54 and 55. The first transfer pulley 51 is opposed to the photoreceptor drum 32*a* so as to make a first transfer for transferring a developed toner image. The second transfer pulley 52 is opposed to the transfer roller 35 so as to make a second transfer for transferring the transferred toner image to the recording paper located at the recording and forming position P. The driven pulley 53, disposed opposite this second transfer pulley 52, is driven to rotate. And, the tension pulleys 54 and 55 place a tension on the belt to prevent positional displacement, etc. from occurring. In this intermediate transfer belt 34, for example, shims 34*a* (shown in FIG. 4) projecting outward in a planar direction are disposed on one side of the side edges of the belt. A sensor 56 detects these shims 34*a* for each revolution, whereby the CPU 13 of the engine controller 12 controls rotational driving in synchronism with the rotation of the photoreceptor drum 32*a* and the transport of recording paper. Thereby, the intermediate transfer belt 34 faces the recording paper transported to the image recording and forming position P opposed to the transfer roller 35 and is rotationally driven so as to circulate repeatedly through a path opposed to the photoreceptor drum 32*a*. Thus, the intermediate transfer belt 34 receives and transfers a toner image of each color toner formed on this photoreceptor drum 32*a* to the recording paper at the image recording and forming position P.

Figure 4A:
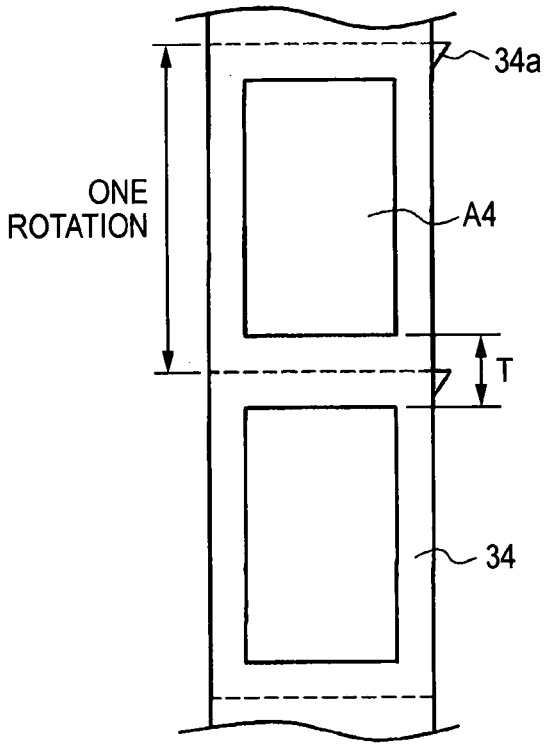

The intermediate transfer belt 34 thus circulates and rotates, while the developing rotary unit 33, particularly to form a color image, need sequentially switch the developing cartridges 37 for developing a toner image. Consequently, when the size of recording paper designed capable of forming a color image thereon is set to A size for example, as shown in FIG. 4A, it is necessary that this intermediate transfer belt 34 meet the following necessities. That is, the intermediate transfer belt 34 need hold a toner image A4 to be transferred to the A4 size recording paper. And, the intermediate transfer belt 34 need secure a period T during which the developing cartridge 37 switching operation is completed within a time required to rotationally move the distance between the trailing end of one toner image A4 and the leading end of the next toner image A4 (between the trailing end of one recording paper and the leading end of the next recording paper, i.e., between adjacent papers). To meet such necessities, the intermediate transfer belt 32 is formed to have, in addition to the length of the A4 size toner image A4, a belt length including a region T for securing a rotational movement period longer than or equal to a time equivalent to the period T.

In other words, when the four developing cartridges 37*k* are attached to the developing rotary unit 33 and a monochrome toner image is to be successively formed on this intermediate transfer belt 34 and transferred to the recording paper, similarly, the developing cartridges 37*k* can be switched within the period T during which the region T, between the trailing and leading ends of the toner images A4 to be transferred to the preceding and subsequent recording papers, moves rotationally as shown in FIG. 4A. Consequently, even to form a monochrome image on the A4 size recording paper, the developing cartridges 37*k* are switched for each rotation of the intermediate transfer belt 34 (for each development, for each recording paper) to develop an electrostatic latent image on the photoreceptor drum 32*a*, thus enabling image formation.

Figure 4B:
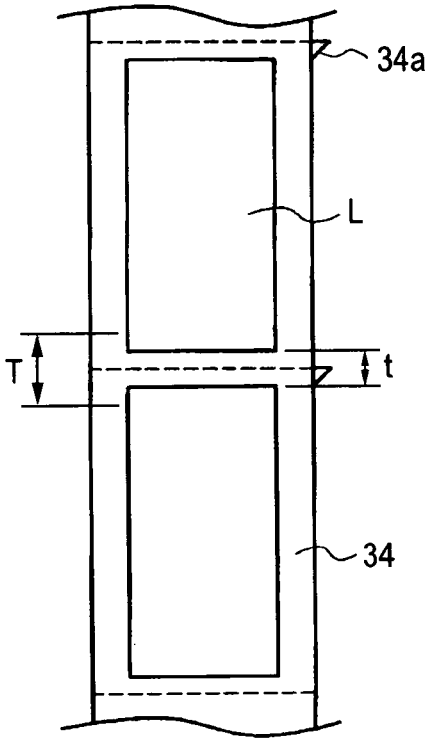

On the contrary, when the developing cartridges 37*k* are not to be switched for each development, as shown in FIG. 4B, in the case of a monochrome image, image formation can also be provided such that a toner image is held even in the region T of the intermediate transfer belt 34 and transferred to recording paper. For example, even in the case of recording paper of legal size slightly longer than A4 size in a sub-scan direction, image formation can be provided such that a monochrome toner image L of legal size to be transferred to this recording paper is developed and held on the intermediate transfer belt 34.

Consequently, when being utilized as an apparatus for exclusive use in forming a monochrome image by attaching the four developing cartridges 37*k* to the developing rotary unit 33, this image forming apparatus is designed capable of providing image formation by transferring to the image recording and forming position P the recording paper of legal size larger than A4 size placed in the paper cassette 21. With such a design, the developing cartridge 37*k* switching operation is appropriately performed in response to the size of recording paper on which the received image data is to be formed, thus carrying out an image forming operation.

Besides, the developing cartridges 37 each have a built-in nonvolatile memory 42 and a built-in development side connector 43, and a control side connector 44 is disposed on the developing rotary unit 33 side. The nonvolatile memory 42 rewritably stores therein identification information such as a serial number and a variety of information such as the color, manufacture date, and consumption of the stored toner. The development side connector 43 is connected to the nonvolatile memory 42 to perform reading and rewriting of the information stored therein the control side connector 44 is disposed so as not to move to the outer periphery of the developing rotary unit 33 and, when facing the development side connector 43 of any of the developing cartridges 37, exchanges the variety of information in noncontact communication therewith. Thereby, the engine controller 12 of the control unit 10 appropriately comprehends the presence/absence and position of the developing cartridges 37 housed within the housing positions of the developing rotary unit 33 and also the variety of information such as the toner color information of these developing cartridges 37. Thus, the engine controller 12 carries out optimum image forming control inclusive of developing cartridge 37 switching control.

Specifically, the CPU 13 of the engine controller 12 is configured to, after power on, carries out various control operations in accordance with the control program in the ROM 14. Thus, upon power on or replacement of the developing cartridges 37, the CPU 13 performs the noncontact communication routed through the connectors 43 and 44 and thereby holds (stores) in the main memory 15 the presence/absence of the developing cartridges 37 within the housing positions of the developing rotary unit 33. Besides, this CPU 13 sequentially reads the variety of information written in the nonvolatile memories 42 of the developing cartridges 37 via the connectors 43 and 44 and holds in the main memory 15 the position information per developing cartridge 37, the color information and consumption (remaining amount) of toner, etc. Furthermore, during the image forming operation or after the end of image formation, this CPU 13 writes and rewrites the variety of information, such as an amount of toner consumed by the image formation, to the nonvolatile memories 42 of the developing cartridges 37 via the connectors 43 and 44.

On this occasion, when knowing that the developing cartridges 37*y*, 37*m*, 37*c*, and 37*k* storing therein the color toners of yellow (Y), cyan (C), magenta (M), and black (K) are placed in the developing rotary unit 33, the CPU 13 performs general image forming control to rotate the developing rotary unit 33 in response to image data transmitted from the controller 11, thereby recording and forming a color image or a monochrome image on one or both sides of recording paper. In other words, each time upon receiving an instruction to print the image data, the developing cartridges 37 of the individual color toners attached to the developing rotary unit 33 operate as being appropriately switched in response to the kind of images based on the image data. Thereby, in the developing cartridges 37*y*, 37*m*, 37*c*, and 37*k*, the supply rollers 37*d* for supplying the stored toners to the developing rollers 37*d* are also supplied with the stored toners as the developing rotary unit 33 rotates.

On the other hand, when knowing that the image forming apparatus is utilized as an apparatus for exclusive use in forming a monochrome image with the four developing cartridges 37*k* storing the toner of black (K) therein attached to the developing rotary unit 33, the CPU 13 carries out image forming control for switching the developing cartridges 37*k* in response to the size of recording paper on which to record and form the received image data. Thus, the monochrome image corresponding to the image data transmitted from the controller 11 is recorded and formed on one or both sides of recording paper placed in the paper cassette 21.

Figure 5:
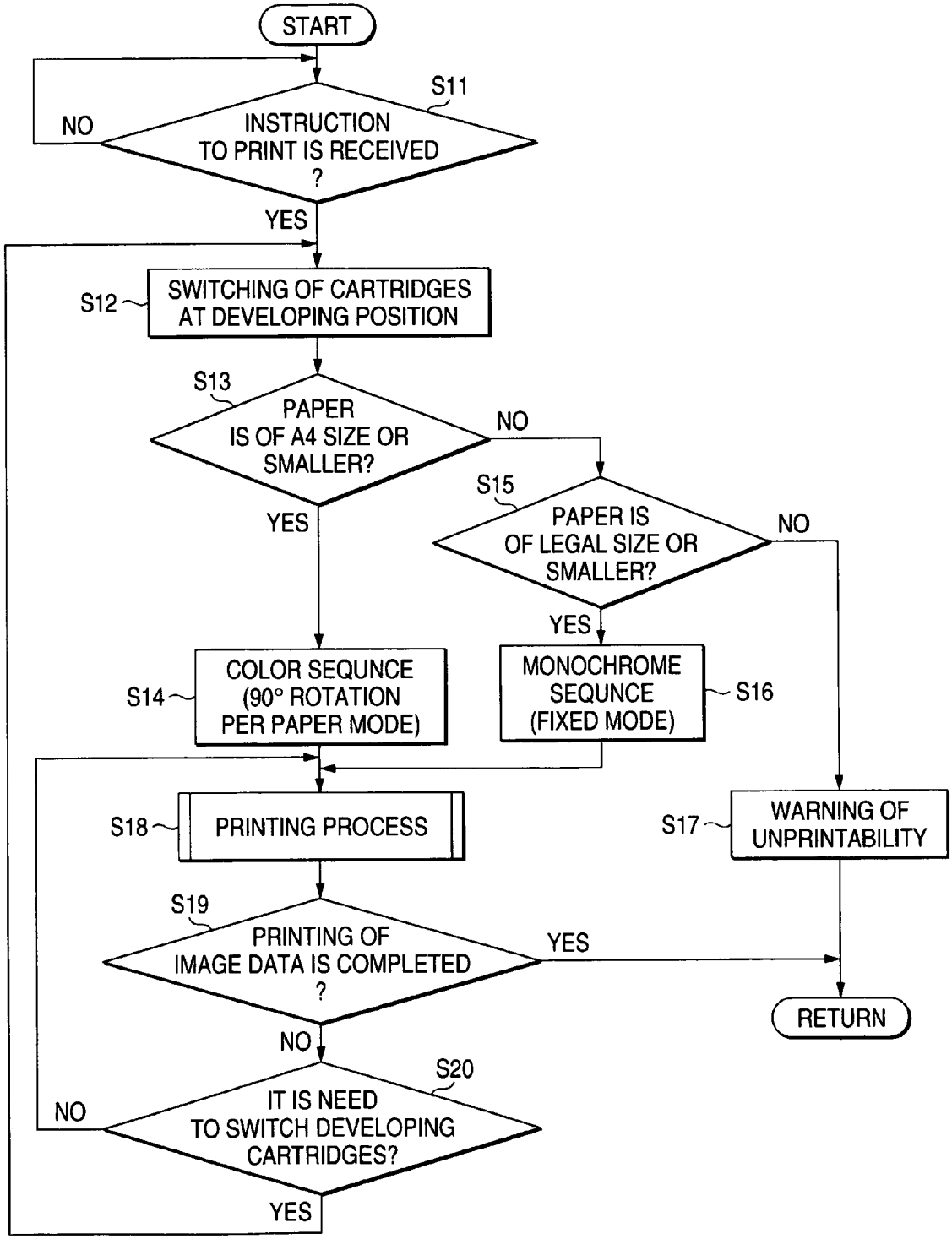
FIG. 5 is a flowchart illustrating image forming control according to the first embodiment.

For example, as shown in the flowchart of FIG. 5, the CPU 13 receives from the controller 11 an instruction to print image data of a monochrome image (Step S11). Then, the CPU 13 switches the developing cartridges 37 by rotating the developing rotary unit 33 to move the next developing cartridge 37*k* to the developing position opposed to the photoreceptor drum 32*a* (Step S12). Thereafter, the CPU 13 determines whether or not a size of the recording paper on which the received image data is to be formed is equal to or smaller than A4 size (Step S13). When the recording paper is smaller than A4 size, for example B5 size, as with color image formation, the CPU 13 selects a color sequence of image forming mode for switching the developing cartridges 37*k* to be set at the developing position by rotating the developing rotary unit 33 90° for each recording paper (Step S14). On the contrary, when this recording paper exceeds A4 size, the CPU 13 determines whether or not it is of legal size or smaller (Step S15). When the recording paper is of legal size or smaller, as with successive monochrome image formation, the CPU 13 selects a monochrome sequence of image forming mode for fixing the developing cartridge 37*k* set at the developing position without rotating the developing rotary unit 33 (Step S16). Furthermore, when the recording paper exceeds even legal size, which is beyond the design range and enables no image formation, the CPU 13 performs the process of notifying the personal computer PC of unprintability and puts this image forming control to an end (Step S17).

After this determination on the recording paper size, the CPU 13 starts driving control over the paper transport device 20 and image recording device 30 for printing the received image data, thus providing image formation to one or both sides of the recording paper (Step S18).

Subsequently, each time this printing process per recording paper comes to an end, the CPU 13 determines whether the process of printing the received image data is completed or not (Step S19). When the printing process is completed, the CPU 13 puts this image forming control to an end accordingly.

On the contrary, when the printing process is not completed, the CPU 13 checks whether an amount of image formation, which causes the developing cartridge 37*k* in use to run out of toner, is exceeded or not. And, when the monochrome sequence for fixing the developing cartridge 37*k* is selected, the CPU 13 checks whether an amount of image formation, which can complete the image forming operation without replenishing the stored toner into the supply roller 37*d* placement space, is exceeded or not. Thus, the CPU 13 determines whether no not it is required to switch the developing cartridges 37*k* to be set at the developing position (Step S20).

And, when the amount of image formation is not exceeded, the CPU 13 returns to Step S18 and carries on the printing process using the same developing cartridge 37*k* without rotating the developing rotary unit 33.

Besides, when the amount of image formation is exceeded and the process of printing the received image data cannot be completed using the same developing cartridge 37*k*, the CPU 13 returns to Step S12 and performs the switching operation for moving the next cartridge 37*k* to the developing position by rotating the developing rotary unit 33. Thus, the CPU 13 carries on the process of printing the remaining image data. On this occasion, the developing cartridges 37*k* are switched to be put to use each time upon receipt of an instruction to print and for each recording paper when it is of A4 size or smaller. Therefore, this enables as even consumption as possible of the stored toners and also the adjacent developing cartridge 37*k* to move rapidly to the developing position, so that an image forming speed (so-called throughput) can be maintained as constant as possible.

Accordingly, the image forming control performed by switching the developing cartridges 37*k* or the image forming control performed by fixing the developing cartridge 37*k* is selected and executed in response to whether recording paper on which the image data to be recorded and formed is equal to or smaller than A4 size or legal size. Thus, in the case of a color image, the function of image formation can be left to serve as it is up to the A4 size recording paper, while in the case of a monochrome image, image formation can be provided even to the recording paper of legal size.

On this occasion, when recording paper on which the monochrome image is to be formed is up to A4 size, image formation can be provided to the recording paper while performing the adjusting operation of agitating and replenishing the stored toner by switching the developing cartridges 37*k* for each recording paper (for each revolution of the intermediate transfer belt). Besides, when recording paper on which to form the monochrome image is of legal size, image formation can be provided such that, without switching the developing cartridges 37*k*, a toner image is held even in the region T of the intermediate transfer belt 34 for securing the developing cartridge 37*k* switching operation period and transferred to the recording paper.

Thus, in this embodiment, when the image forming apparatus is used as an apparatus for exclusive use in forming a monochrome image by attaching thereto the four developing cartridges 37*k* storing the toner of black (K), image formation can be provided by effectively utilizing the length of the intermediate transfer belt 34. Thus, in addition to recording and forming a color image on the recording paper of up to A4 size, a monochrome image can be recorded and formed on the recording paper of legal size. Besides, in the developing cartridges 37*k*, the adjusting operation of agitating and replenishing the stored toner is performed by the switching operation of with the rotation the developing rotary unit 33, which therefore makes it possible to omit a device for performing such an adjusting operation. Accordingly, it is possible to meet demands on the size of recording paper to which to provide image formation, to the maximum extent possible, while realizing a reduction in size and cost without impairing an image formation speed (so-called throughput) or image quality.

Figure 6:
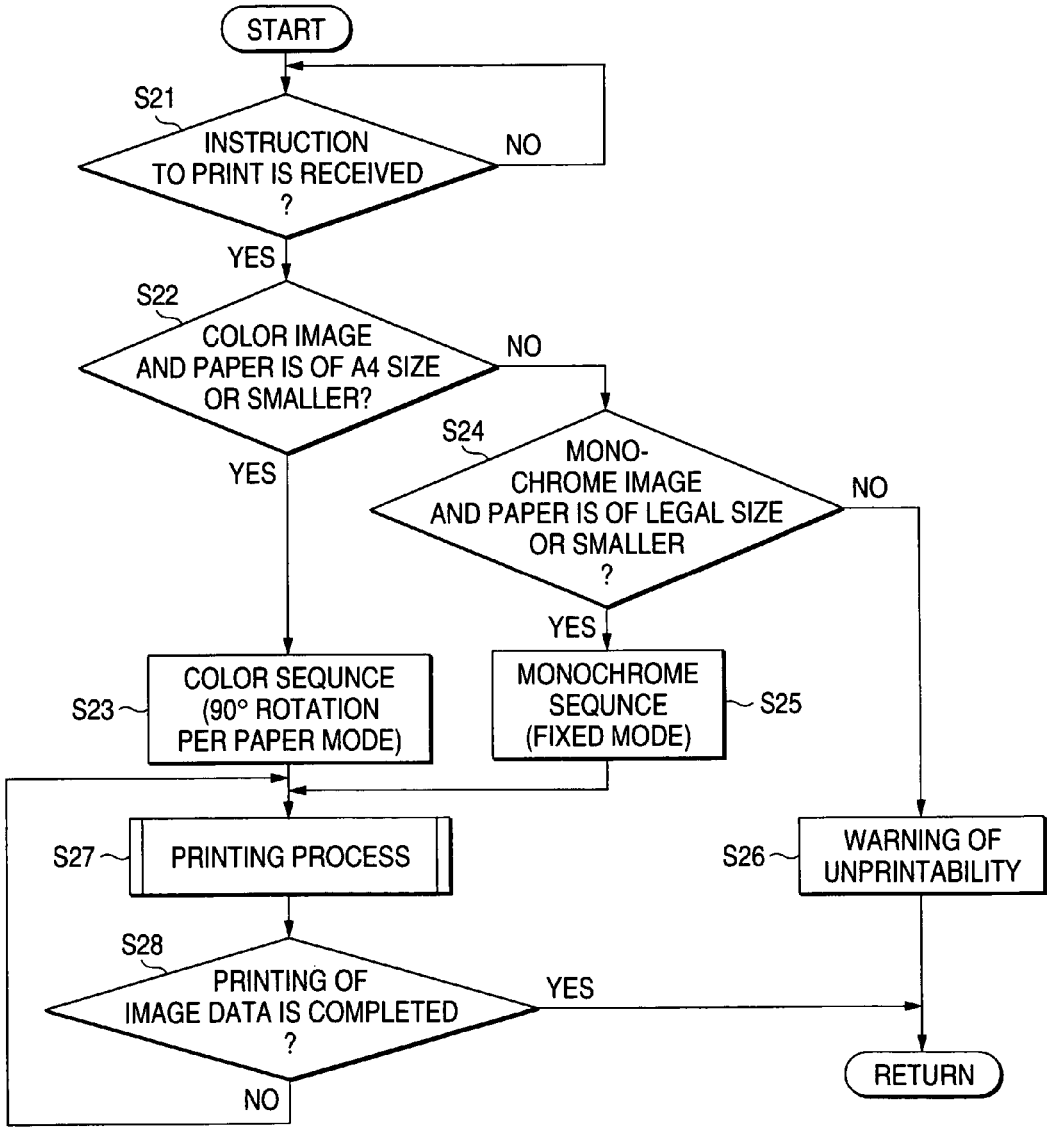
FIG. 6 is a flowchart illustrating image forming control of the image forming apparatus according to a second embodiment of the invention.

Next, FIG. 6 is a view showing a second embodiment of the image forming apparatus according to the invention. Additionally, in this embodiment, since the apparatus thereof is configured substantially the same as that of the aforesaid embodiment, by reference to the same drawings, distinctive features will be described with similar parts identified by like reference numerals.

In FIGS. 1 to 4, the image forming apparatus is designed as follows. That is, even in utilizing the function of forming images ranging from a color image to a monochrome image by attaching to the apparatus the developing cartridges 37*y*, 37*m*, 37*c*, and 37*k* storing the color toners of yellow (Y), cyan (C), magenta (M), and black (K), only the monochrome image can be formed such that the recording paper of legal size larger than A4 size placed in the paper cassette is transported to the recording and forming position P.

Specifically, as shown in the flowchart of FIG. 6, the CPU 13 of the engine controller 12 receives an instruction to print image data from the controller 11 (Step S21). Then, the CPU 13 determines whether or not the received image data is data for recording and forming a color image and simultaneously whether or not recording paper on which to print the image data is of A4 size or smaller (Step S22). When this condition is met, the CPU 13 selects the color sequence of image forming mode for sequentially switching the developing cartridges 37*y*, 37*m*, and 37*c* at the developing position by rotating the developing rotary unit 33 90° for each rotation of the intermediate transfer belt 34 (Step S23).

On the contrary, when this image data is not a color image or when the recording paper exceeds A4 size, the CPU 13 determines whether the image data is of monochrome image or not and simultaneously whether the recording paper is of legal size or not (Step S24). When this condition is fulfilled, the CPU 13 selects the monochrome sequence of image forming mode for fixing the developing cartridge 37*k* set at the developing position without rotating the developing rotary unit 33 (Step S25).

Furthermore, when the image data is for color image but the recording paper exceeds A4 size or when the image data is for monochrome image but the recording paper exceeds legal size, which is beyond the design range and enables no image formation, the CPU 13 performs the process of notifying the personal computer PC of unprintability and puts this image forming control to an end (Step S26).

After determination of this image data, the CPU 13 starts driving control over the paper transport device 20 and image recording device 30 for printing the received image data, thus providing image formation to one or both sides of the recording paper (Step S27).

Subsequently, each time this printing process per recording paper comes to an end, the CPU 13 determines whether the process of printing the received image data is completed or not (Step S28). When the printing process is completed, the CPU 13 puts this image forming control to an end accordingly. On the contrary, when the printing process is not completed, the CPU 13 returns to Step S27 and carries on the printing process. On this occasion, when the developing cartridge 37 in use runs out of toner, the CPU 13 performs the process of interrupting this image forming control and notifying the personal computer PC that the developing cartridge 37 need be replaced to replenish toner.

Accordingly, in the case of a color image, the function of image formation up to A4 size is maintained to serve as it is. In contrast, when recording paper on which the image data for a monochrome image is to be formed is of legal size or smaller, the image forming control performed by fixing the developing cartridge 37*k* is selected and executed. And, a toner image is held even in the region T of the intermediate transfer belt 34 for securing the developing cartridge 37 switching operation period. Thus, the monochrome image can be formed on the recording paper of up to legal size.

Thus, in this embodiment, when the image forming apparatus is used as an apparatus capable of forming a color image and a monochrome image by attaching thereto the developing cartridges 37*y*, 37*m*, 37*c*, and 37*k*, the monochrome image can be formed by effectively utilizing the length of the intermediate transfer belt 34. Similar to the aforesaid embodiments, in addition to recording and forming the color image on the recording paper of up to A4 size, the monochrome image can be recorded and formed on the recording paper of legal size. Besides, in the developing cartridges 37*y*, 37*m*, 37*c*, and 37*k*, the adjusting operation of agitating and replenishing the stored toner is performed by the switching operation with the rotation of the developing rotary unit 33, which therefore makes it possible to omit a device for performing such an adjusting operation. Accordingly, it is possible to meet demands on the size of recording paper to which to provide image formation, to the maximum extent possible, while realizing a reduction in size and cost without impairing an image formation speed (so-called throughput) or image quality.

Additionally, in the first and second embodiments, the image forming apparatus is described as image forming apparatuses of different configurations but, needless to say, may include both functions. Besides, the size of recording paper serving as a criterion is not limited to A4 or legal size, but may be B5 size and A4 size, for example. Furthermore, to form a monochrome image on both sides of the recording paper of legal size, the developing cartridges 37*k* can be switched within the inverting period for synchronously stopping the photoreceptor drum 32*a* and the intermediate transfer belt 34. Therefore, as with the recording paper of A4 size, the configuration may be such as to provide image formation while switching the developing cartridges 37*k* at the developing position for each recording paper.

Besides, the aforesaid first embodiment describes the following image forming control as an example. That is, when the image forming apparatus is used as an apparatus for exclusive use in forming a monochrome image by attaching the four developing cartridges 37*k* to the developing rotary unit 33, the developing cartridges 37*k* are switched for each recording paper (for each development). However, the invention is not limited thereto but, needless to say, the image forming control may be performed such that the developing cartridges 37*k* are switched at the developing position as appropriate after a predetermined amount of image formation is carried out.

Furthermore, the second embodiment describes, as an example, the case in which a device (e.g., agitator device or auger device) for performing the adjusting operation of agitating and replenishing the stored toner is omitted from within the developing cartridge 37*k*. However, it is needless to say that such a device may be provided therein.

Figure 7:
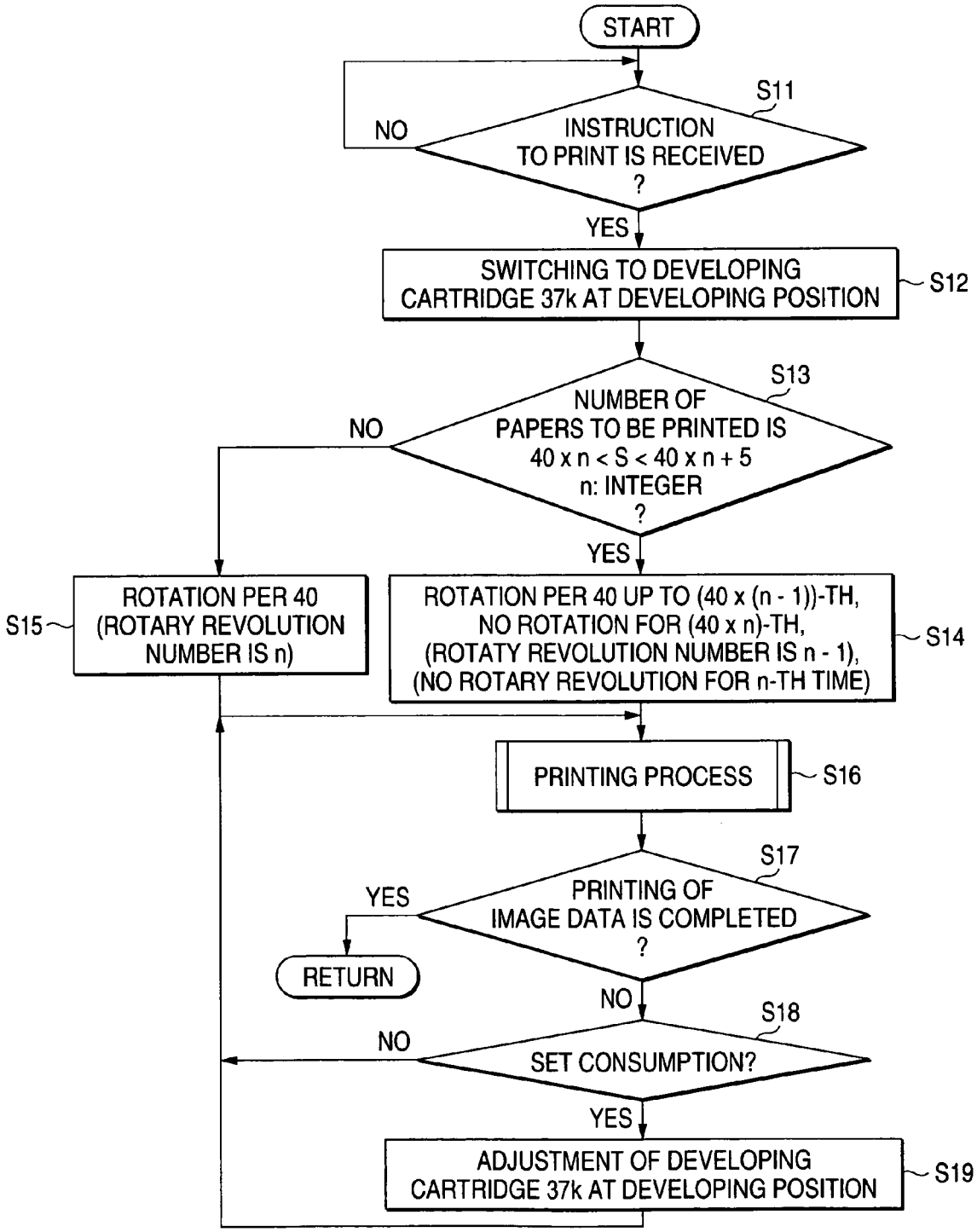
FIG. 7 is a flowchart illustrating image forming control of the image forming apparatus according to the third embodiment.

Next, FIG. 7 is a view showing a third embodiment of the image forming apparatus according to the invention. Additionally, in this embodiment, since the apparatus thereof is configured substantially the same as that of the aforesaid embodiments, by reference to the same drawings, distinctive features will be described with similar parts identified by like reference numerals.

In this embodiment, when grasping that the developing cartridges 37*y*, 37*m*, 37*c*, and 37*k* storing therein the color toners of yellow (Y), cyan (C), magenta (M), and black (K) are placed in the developing rotary unit 33, upon receipt of image data for forming a color image from the controller 11, the CPU 13 rotates the developing rotary unit 33 in response to the image data. Thereby, the developing cartridges 37*y*, 37*m*, 37*c*, and 37*k* are sequentially switched at a developing position opposed to the photoreceptor drum 32*a*, thereby recording and forming the color image on one or both sides of the recording paper. In other words, the developing cartridges 37 of the individual color toners attached to the developing rotary unit 33 operate as being appropriately switched each time upon receiving an instruction to print the image data of the color image. Thereby, in the developing cartridges 37*y*, 37*m*, 37*c*, and 37*k*, the supply rollers 37*d* for supplying the stored toners to the developing rollers 37*d* are also appropriately replenished with the stored toners as the developing rotary unit 33 rotates.

Upon receipt of image data for forming a monochrome image from the controller 11, the CPU 13 switches the developing cartridge 37 to the developing cartridge 37*k* to be fixed to the developing position opposed to the photoreceptor drum 32*a*, thereby successively recording and forming the monochrome image on one or both sides of recording paper. On this occasion, based on the content of image forming job information for recording and forming the received image data on recording paper, the CPU 13 rotates the rotary unit through one revolution to perform the operation of adjusting the stored toner in the developing cartridge 37*k*. For example, the CPU 13 compares an amount of the toner of black (K) consumed by carrying out the recording and forming (image formation) of image data, with an margin consumption and a limit consumption that are pre-set in the main memory 15. And, the CPU 13 rotates the developing rotary unit 33 through one revolution, thus determining the timing of adjusting the stored toner in the developing cartridge 37*k*.

Here, the margin consumption refers to the consumption of toner obtained such that a margin (sufficient safety) is secured by subtracting a predetermined amount from an actual limit amount of toner consumed until no more toner to be supplied to the developing roller 37*b* remains around the supply roller 37*d*. As the margin consumption, for example, image formation on 40 recording papers is set in the main memory 15. Besides, the limit consumption refers to the consumption of toner obtained by subtracting a predetermined amount from the actual limit amount of toner consumed, such as by reducing a slight extra amount from the margin consumption. As the limit consumption, for example, image formation on 45 recording papers obtained by adding 5 to the margin consumption is set in the main memory.

For example, as shown in the flowchart of FIG. 7, the CPU 13 receives from the controller 11 an instruction to print image data of a monochrome image (Step S11). Then, the CPU 13 switches the developing cartridges 37 by rotating the developing rotary unit 33 to move the developing cartridge 37*k* to the developing position opposed to the photoreceptor drum 32*a*, and resets the consumption of toner (the number of recording papers to which to provide image formation) stored in the main memory 15 (Step S12). On this occasion, when the developing cartridge 37*k* is already positioned at the developing position, the CPU 13 resets the consumption of toner in the main memory 15 by performing the adjusting operation, such as by rotating the developing rotary unit 33 through one revolution to replenish the stored toner in the developing cartridge 37*k*. Additionally, when a warm-up operation, etc. take only a short time and the printing process is ready to start immediately, it is more advantageous to an improvement in so-called throughput to omit the stored toner adjusting operation by adopting a configuration such that the consumption of toner in the main memory 15 is added without rotating the developing rotary unit 33 and without resetting the aforesaid consumption of toner. However, in this case, it is necessary to take into consideration an amount of toner consumed by the preceding printing process which amount has been stored in the main memory 15.

Subsequently, as for the number of recording papers on which to print the received image data (the number of recording papers will hereinafter be sometimes indicated simply by its number only), the CPU 13 determines whether or not the remainder obtained by repeating image formation on 40 of the margin consumption (the quantity that remains after division by 40) falls within 45 of the limit consumption, in other words, whether or not the number of papers S to be printed satisfies the following expression (Step S13).

$$40\times n \text{ (number of papers)} < S \text{ (number of papers)} < 40\times n+5 \text{ (number of papers)} \quad n\text{: integer}$$

When the above expression is satisfied, the CPU 13 performs the adjusting operation of agitating and replenishing the stored toner in the developing cartridge 37*k* by rotating the developing rotary unit 33 through one revolution every 40 of the margin consumption up to the [40×(n−1)]-th paper. Thereafter, the CPU 13 selects and sets image forming control so as to carry on the printing process that ends by the 45th of the limit consumption without performing the stored toner adjusting operation for the (40×n)-th paper (Step S14). That is, in this case, the developing rotary unit 33 rotates (n−1) times and does not rotate for the n-th time.

Besides, when the above expression is not satisfied, as per normal, the CPU 13 selects and sets image forming control for performing the adjusting operation of agitating and replenishing the stored toner in the developing cartridge 37*k* by rotating the developing rotary unit through one revolution every 40 of the margin consumption without setting the limit consumption (Step S15). That is, in this case, the developing rotary unit 33 rotates n times.

After setting the consumption with the timing of performing this stored toner adjusting operation, the CPU 13 starts driving control over the paper transport device 20 and image recording device 30 for printing the received image data, thus providing image formation to one or both sides of recording paper (Step S16).

Subsequently, each time this printing process per recording paper comes to an end, the CPU 13 determines whether the process of printing the received image data is completed or not (Step S17). When the printing process is completed, the CPU 13 puts this image forming control to an end accordingly.

When the printing process is not completed, the CPU 13 determines whether or not the consumption of the stored toner is the set timing and exceeds 40 of the margin consumption (Step S18). When the cumulative number of papers subjected to the printing process is beyond 40, the CPU 13 returns directly to Step S16 and carries on the printing process using the developing cartridge 37*k* without performing the stored toner adjusting operation by rotating the developing rotary unit 33. Even when the consumption of the stored toner is beyond 40 recording papers but the limit consumption is set and simultaneously the rotation number of the developing rotary unit 33 reaches the n-th time, then the CPU 13 returns directly to Step S16 and carries on the printing process using the developing cartridge 37*k* without performing the stored toner adjusting operation by rotating the developing rotary unit 33 through one revolution.

On the contrary, when the consumption of the stored toner is beyond 40 and the rotation number of the developing rotary unit 33 is less than n times, regardless of whether the limit consumption is set or not, the CPU 13 performs the adjusting operation of agitating and replenishing the stored toner in the developing cartridge 37*k* by rotating the developing rotary unit 33 through one revolution and resets the consumption of toner stored in the main memory 15 (Step S19). Thereafter, the CPU 13 returns to Step S16 and restarts the printing process using the developing cartridge 37*k*.

Accordingly, before carrying out an image forming job for printing the received image data on recording paper, the CPU 13 determines the consumption of the stored toner necessary for the printing process. Thus, the rotation of the developing rotary unit 33 can be avoided from forcibly cutting into the image forming job even when the image forming job can be completed without performing the stored toner adjusting operation. This enables rapid completion of the image forming job without any unnecessary interruption.

In this embodiment, when the image forming apparatus is used capable of forming a color image and a monochrome image by attaching thereto the developing cartridges 37*y*, 37*m*, 37*c*, and 37*k*, upon successive formation of the monochrome image with the developing cartridge 37*k* positioned at the developing position, the CPU 13 determines the timing (necessity of the adjusting operation) of starting the operation of adjusting the stored toner in the developing cartridge 37*k* by rotating the developing rotary unit 33 through one revolution, in response to the consumption of the stored toner necessary to process the image forming job. Thereby, the stored toner adjusting operation can be omitted when the image forming job can be completed if the printing process is carried on as is while repeating the stored toner adjusting operation with a loose timing. Accordingly, the timing of performing the operation of adjusting the stored toner in the developing cartridge 37*k* is controlled so that it possible to avoid an image forming job from being interrupted. And, an image forming speed (so-called throughput) can be increased by rapidly completing the image forming job.

Figure 8:
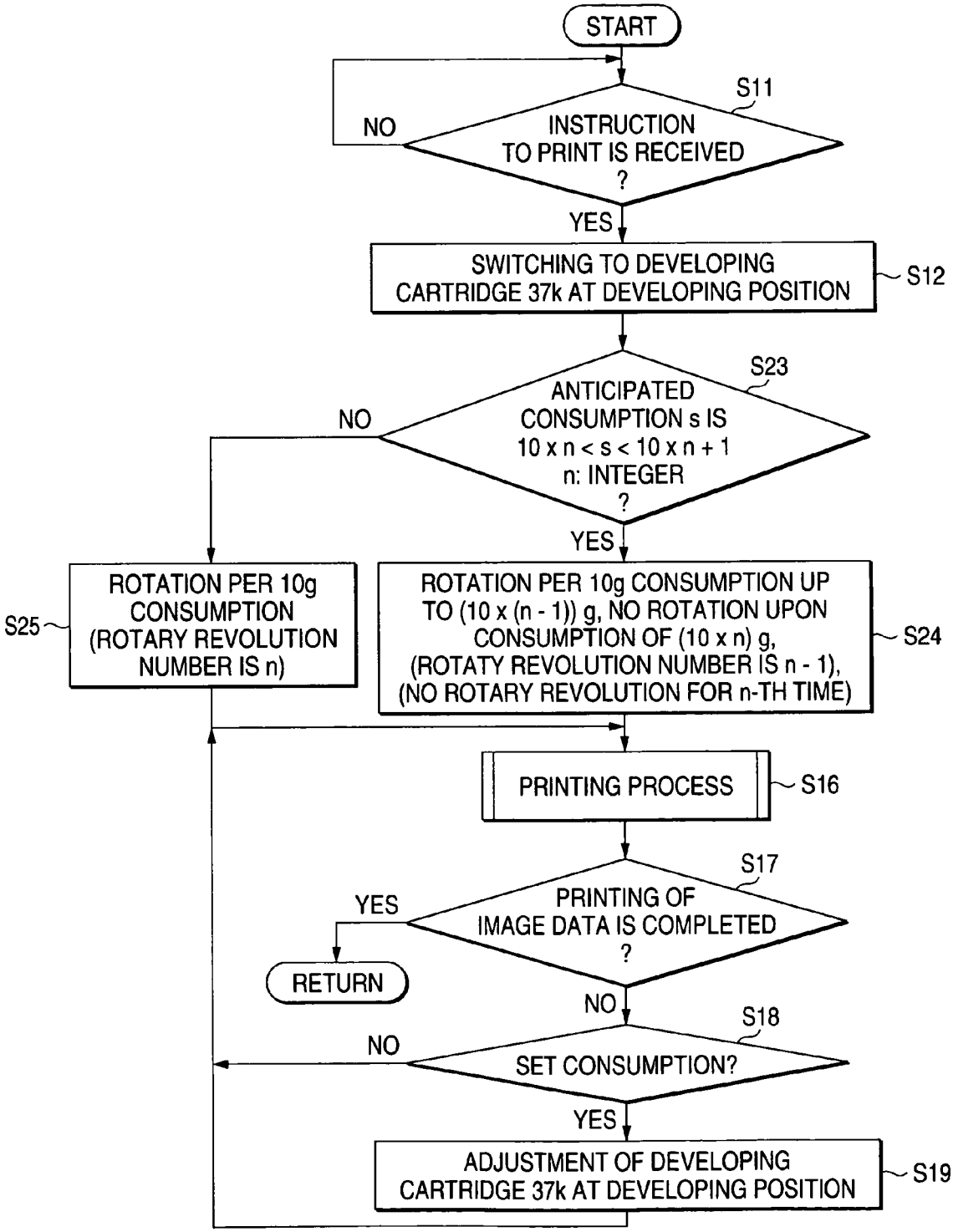
FIG. 8 is a diagram showing a flowchart illustrating the image forming control of the image forming apparatus according to a fourth embodiment of the invention.

Next, FIG. 8 is a diagram showing a fourth embodiment of the image forming apparatus according to the invention. Additionally, in this embodiment, since the apparatus thereof is configured substantially the same as that of the aforesaid embodiments, distinctive features will be described by reference to the same drawings (The same applies to another embodiment to be described below).

In FIGS. 1 to 3, in the main memory 15 of the engine controller 12, the number of grams representing the consumption of the stored toner used in image formation is set as the margin consumption or limit consumption of image forming job information. For example, 10 g is set as the margin consumption of the consumption of toner obtained before no more toner to be supplied to the developing roller 37*b* remains around the supply roller 37*d*. 11 g obtained by adding 1 g to the margin consumption is set as the limit consumption. Here, in the third embodiment, as the margin consumption, etc., the number of recording papers equivalent to the consumption of toner is set in the main memory 15. However, the invention is not limited to these parameters, for example, a count value obtained from a counter, the number of dots in an image, a cumulative developing operation (image formation) time, or a measured amount of toner remaining are available to the invention.

Figure 9:
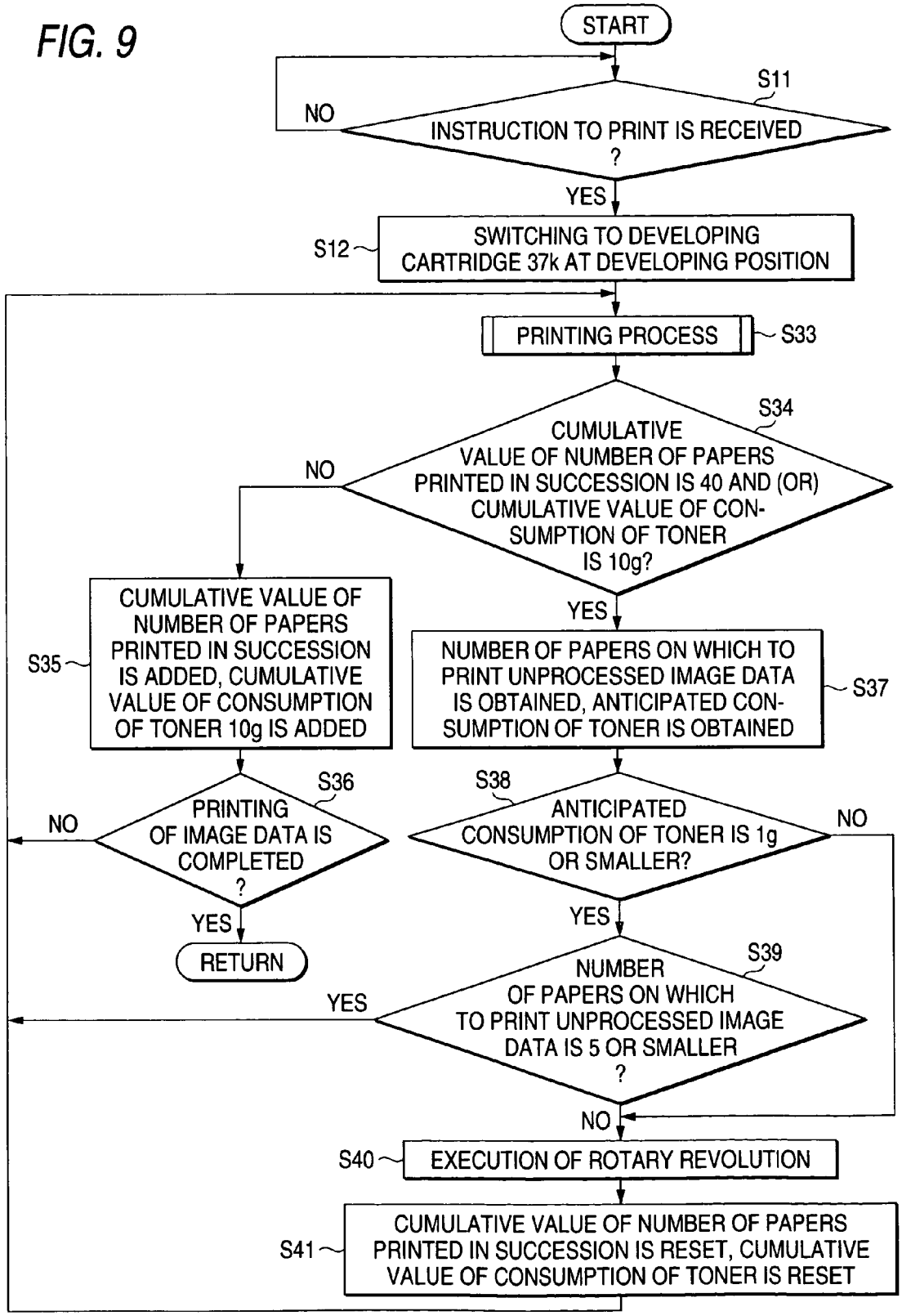
FIG. 9 is a diagram showing a flowchart illustrating image forming control of the image forming apparatus according to a fifth embodiment of the invention.

As shown in the flowchart of FIG. 9, similar to the third embodiment, upon receipt of an instruction to print image data of a monochrome image, the CPU 13 of the engine controller 12 switches the developing cartridges 37*k* by rotating the developing rotary unit 33 and simultaneously resets the consumption (number of grams) of toner stored in the main memory 15 (Steps S11 and S12).

Thereafter, as for the stored toner necessary to print the received image data, the CPU 13 determines whether or not the remainder obtained by repeating image formation of 10 g of the margin consumption (the quantity that remains after division by 10 g) falls within 11 g of the limit consumption, in other words, whether or not an anticipated consumption s satisfies the following expression (Step S13).

$$10\times n(g)<s(g)<10\times n+1(g)\quad n\text{: integer}$$

When the above expression is satisfied, the CPU 13 performs the adjusting operation of agitating and replenishing the stored toner in the developing cartridge 37*k* by rotating the developing rotary unit 33 through one revolution every 10 g of the margin consumption up to [10×(n−1)]g. Thereafter, the CPU 13 selects and sets image forming control so as to carry on the printing process that ends by 11 g of the limit consumption without performing the stored toner adjusting operation for the (10×n)g-th time (Step S24). That is, in this case, the developing rotary unit 33 rotates (n−1) times and does not rotate for the n-th time.

Besides, when the above expression is not satisfied, as per normal, the CPU 13 selects and sets image forming control for performing the adjusting operation of agitating and replenishing the stored toner in the developing cartridge 37*k* by rotating the developing rotary unit through one revolution every 10 g of the margin consumption without setting the limit consumption (Step S25). That is, in this case, the developing rotary unit 33 rotates n times.

After setting the consumption for performing this stored toner adjusting operation, similar to the third embodiment, the CPU 13 starts driving control over the paper transport device 20 and image recording device 30 for printing the received image data. Then, the CPU 13 repeats the stored toner adjusting operation by rotating the developing rotary unit 33 through one revolution until the process of printing one or both sides of each recording paper comes to an end, and carries on the printing process using the developing cartridge 37*k* (Steps S16 and S17).

On this occasion, when the consumption of the stored toner in the developing cartridge 37*k* is not beyond 10 g, or even when the consumption of the stored toner is beyond 10 g but the limit consumption is set and simultaneously the rotation number of the developing rotary unit 33 reaches the n-th time, then the CPU 13 returns directly to Step S16 and carries on the printing process using the developing cartridge 37*k* without performing the stored toner adjusting operation by rotating the developing rotary unit 33 through one revolution.

On the contrary, when the consumption of the stored toner is beyond 10 g and simultaneously the rotation number of the developing rotary unit 33 is less than n times, the CPU 13 performs the adjusting operation of agitating and replenishing the stored toner in the developing cartridge 37*k* by rotating the developing rotary unit 33 through one revolution and resets the consumption of toner stored in the main memory 15 (Step S19). Thereafter, the CPU 13 returns to Step S16 and restarts the printing process using the developing cartridge 37*k*.

Thus, even in this embodiment, the same working effect as the third embodiment can be obtained, and the operation of adjusting the stored toner in the developing cartridge 37*k* by rotating the developing rotary unit 33 through one revolution is performed based on the actual consumption of the stored toner. Therefore, the margin consumption and limit consumption are set with better accuracy, thus enabling precision driving control.

Next, FIG. 9 is a diagram showing a fifth embodiment of the image forming apparatus according to the invention.

In FIGS. 1 to 3, similar to the third and fourth embodiments, in the main memory 15 of the engine controller 12, image formation on 40 recording papers and also 10 g of the consumption of the stored toner to be used in the image formation are set as the margin consumption of image forming job information. Besides, image formation on 45 recording papers and also 11 g of the consumption of the stored toner are set as the limit consumption.

In the aforesaid embodiments, the CPU 13 of the engine controller 12 determines and sets the timing of performing the operation of adjusting the stored toner in the developing cartridge 37*k* by rotating the developing rotary unit 33 through one revolution. In this embodiment, instead, the CPU 13 processes an image forming job and, in parallel, determines the necessity of the operation of adjusting the stored toner in the developing cartridge 37*k* and carries out the adjusting operation when needed.

Specifically, as shown in the flowchart of FIG. 9, similar to the first and fourth embodiments, upon receipt of an instruction to print image data of a monochrome image, the CPU 13 switches the developing cartridges 37*k* by rotating the developing rotary unit 33 and simultaneously resets the consumption of toner (number of recording papers and number of grams) stored in the main memory 15 (Steps S11 and S12).

Thereafter, before setting the timing of (the consumption of toner for) performing the stored toner adjusting operation, the CPU 13 starts driving control over the paper transport device 20 and image recording device 30 for printing the received image data, thus providing image formation to one or both sides of recording paper (Step S33).

In this embodiment, each time upon end of the printing process per recording paper, the CPU 13 determines whether or not the consumption of toner is such as not to need the replenishment of the stored toner to the supply roller 37*d* of the developing cartridge 37*k*, for example, whether or not the cumulative number of recording papers to which to provide successive image formation (printing) is 40 or smaller and (AND condition) an actual cumulative amount of toner consumed based on the number of dots in an image, etc. is 10 g or smaller (Step S34). In this embodiment, the determination is made from the AND condition that satisfies both conditions but, needless to say, the invention is not limited thereto. The determination may be made from an OR condition that satisfies any one of the conditions.

When the thus far provided image formation of image data does not satisfy one of the both conditions, then, as it stands, the CPU 13 adds 1 to the cumulative number of papers printed in succession and also adds an actual cumulative consumption to the cumulative amount of toner consumed (Step S35). Thereafter, the CPU 13 determines whether the process of printing the received image data is completed or not (Step S36). When the process of printing the image data is completed, the CPU 13 puts this image forming control to an end accordingly. And, when the printing process is not completed, the CPU 13 returns to Step S33 and carries on the printing process using the developing cartridge 37*k* without performing the stored toner adjusting operation by rotating the developing rotary unit 33.

On the contrary, when the thus far provided image formation of image data satisfies the both conditions, the CPU 13 calculates and obtains the number of recording papers on which to print the unprocessed image data out of the received image data and the consumption of toner anticipated to be necessary to perform image formation on the aforesaid number of recording papers (Step S37).

Subsequently, when the anticipated consumption of toner is 1 g or smaller of the difference between the margin consumption and the limit consumption and also the number of papers on which to print the unprocessed image data is 5 or smaller, then the CPU 13 returns directly to Step S33. And, the CPU 13 carries on the printing process using the developing cartridge 37*k* without performing the stored toner adjusting operation by rotating the developing rotary unit 33 (Steps S38 and S39).

On the contrary, when the anticipated consumption of toner necessary for the process of printing the unprocessed image data is not 1 g or smaller of the difference between the margin consumption and the limit consumption or the number of papers on which to print the unprocessed image data is not 5 or smaller, then the CPU 13 performs the adjusting operation of agitating and replenishing the stored toner in the developing cartridge 37*k* by rotating the developing rotary unit 33 through one revolution. And, the CPU 13 resets the number of papers printed in succession and a cumulative value of the consumption of toner (consumption of toner) that are stored in the main memory 15 (Steps S40 and S41). Thereafter, the CPU 13 returns to Step S33 and restarts the printing process using the developing cartridge 37*k*.

Accordingly, each time upon printing the received image data on recording paper, the CPU 13 determines the consumption of toner necessary for an image forming job to be carried out from now. Thus, the rotation of the developing rotary unit 33 can be avoided from forcibly cutting into the image forming job even when the image forming job can be completed without performing the stored toner adjusting operation. This enables rapid completion of the image forming job without any unnecessary interruption.

Even in this embodiment, the same working effect as the third and fourth embodiments can be obtained, and the operation of adjusting the stored toner in the developing cartridge 37*k* by rotating the developing rotary unit 33 through one revolution is performed based on the number of recording papers printed and the actual consumption of the stored toner. Therefore, the margin consumption and limit consumption are utilized with higher reliability, thus enabling precision driving control.

Here, in the third through fifth embodiments, the image forming apparatus is used capable of forming images ranging from a color image to a monochrome image on recording paper by housing in the developing rotary unit 33 the developing cartridges 37*y*, 37*m*, 37*c*, and 37*k* storing therein the toners of yellow (Y), cyan (C), magenta (M), and black (K). However, the invention is not limited thereto, but is also applicable to, for example, an image forming apparatus that is used as an apparatus for exclusive use in forming the monochrome image by housing in the developing rotary unit 33 four developing cartridges 37*k* storing the toner of black (K) therein. Specifically, the invention is applicable to an image forming apparatus that performs image forming control so that the developing rotary unit 33 is rotated 90° or more at the timing of requiring the adjusting operation of agitating and replenishing the stored toner in any of the developing cartridges 37*k* while positioning the any of the developing cartridge 37*k* at the developing position opposed to the photoreceptor drum 32*a*.

Besides, in the third through fifth embodiments, it is determined whether the operation of adjusting the stored toner in the developing cartridge 37*k* by rotating the developing rotary unit 33 is required at the last timing or not, thus carrying out the stored toner adjusting operation. However, the invention is not limited thereto. For example, in image forming control over the received image data, when the stored toner adjusting operation is performed less frequently for each limit consumption than for each margin consumption, the limit consumption can be used as a stored toner adjusting operation timing. In this case, needless to say, the configuration may be such that a set consumption at the stored toner adjusting operation timing is processed by averaging to make as much allowance as possible.

Furthermore, in the third through fifth embodiments, as an example, the case of individually processing the image forming job information (consumptions of toner) of image data of plural pages from the personal computer PC. However, the invention is not limited thereto. For example, the configuration may be such that upon receipt of the image forming job information of per-page image data or that of separate image data from the personal computer PC, as in the fifth embodiment, the timing of performing the stored toner adjusting operation can be re-set while linking these image forming job information together.

Figure 10:
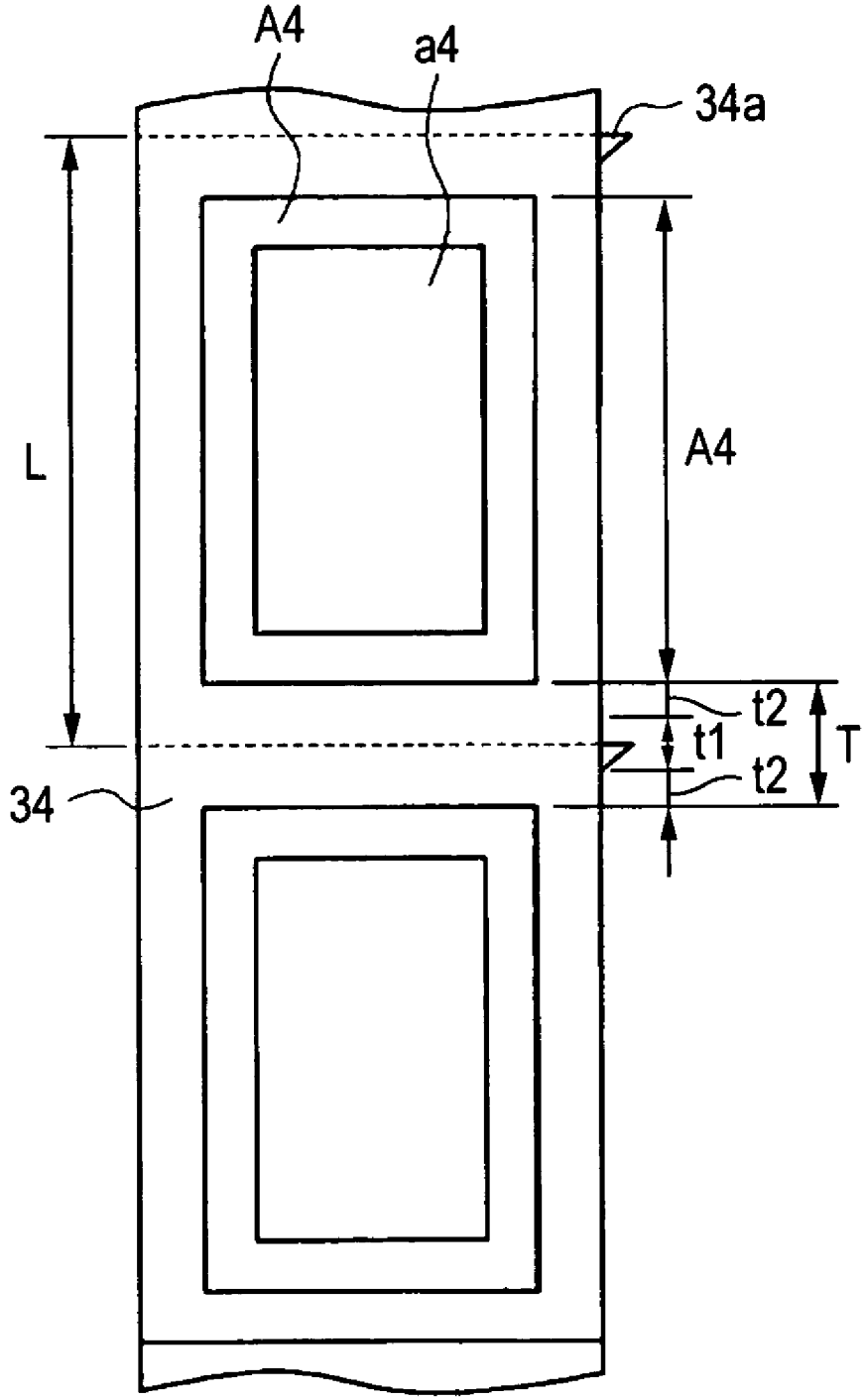
FIG. 10 is a developed plan view showing a toner image forming position on an intermediate transfer belt and a region for performing a developing cartridge switching operation according to a sixth embodiment.

Next, FIG. 10 is a developed plan view showing a toner image forming position on an intermediate transfer belt and a region for performing a developing cartridge switching operation according to a sixth embodiment. In this embodiment, since the apparatus thereof is configured substantially the same as that of the aforesaid embodiments, by reference to the same drawings, distinctive features will be described with similar parts identified by like reference numerals.

The intermediate transfer belt 34 circulates and rotates, while the developing rotary unit 33, particularly to form a color image, need sequentially switch the developing cartridges 37 for developing a toner image. Consequently, when the size (length) of recording paper designed capable of forming a color image thereon is set to A size for example, as shown in FIG. 10, it is necessary that this intermediate transfer belt 34 meet the following necessities. That is, the intermediate transfer belt 34 need carry a toner image a4 to be transferred to the A4 size recording paper. And, the intermediate transfer belt 34 need secure a time t1 during which the developing cartridge 37 switching operation is completed within a time (so-called time between adjacent papers) T required to rotationally move the distance between the trailing end of one recording paper A4 and the leading end of the next recording paper A4. To meet such necessities, the intermediate transfer belt 32 is formed to have, in addition to a region A4 in which to provide the A4 size recording paper A4 with image formation, a belt length L including a region between adjacent papers T for securing a rotational movement period longer than or equal to a time equivalent to the time between adjacent papers T.

In other words, when the four developing cartridges 37*k* are attached to the developing rotary unit 33 and a monochrome toner image is to be successively formed on this intermediate transfer belt 34 and transferred to the recording paper, similarly, it is possible to switch one developing cartridge 37*k* to the adjacent developing cartridge 37*k* within the time between adjacent papers T of the A4 size recording paper. Consequently, even to form a monochrome image on the A4 size recording paper, the developing cartridges 37*k* are switched for each rotation of the intermediate transfer belt 34 (for each development, for each recording paper) to develop an electrostatic latent image on the photoreceptor drum 32*a*, thus enabling image formation. Additionally, within the time between adjacent papers T of recording paper, preparation times a2 for smoothly performing the switching operation in succession are secured before and after the developing cartridge 37 switching operation time t1.

Figure 11:
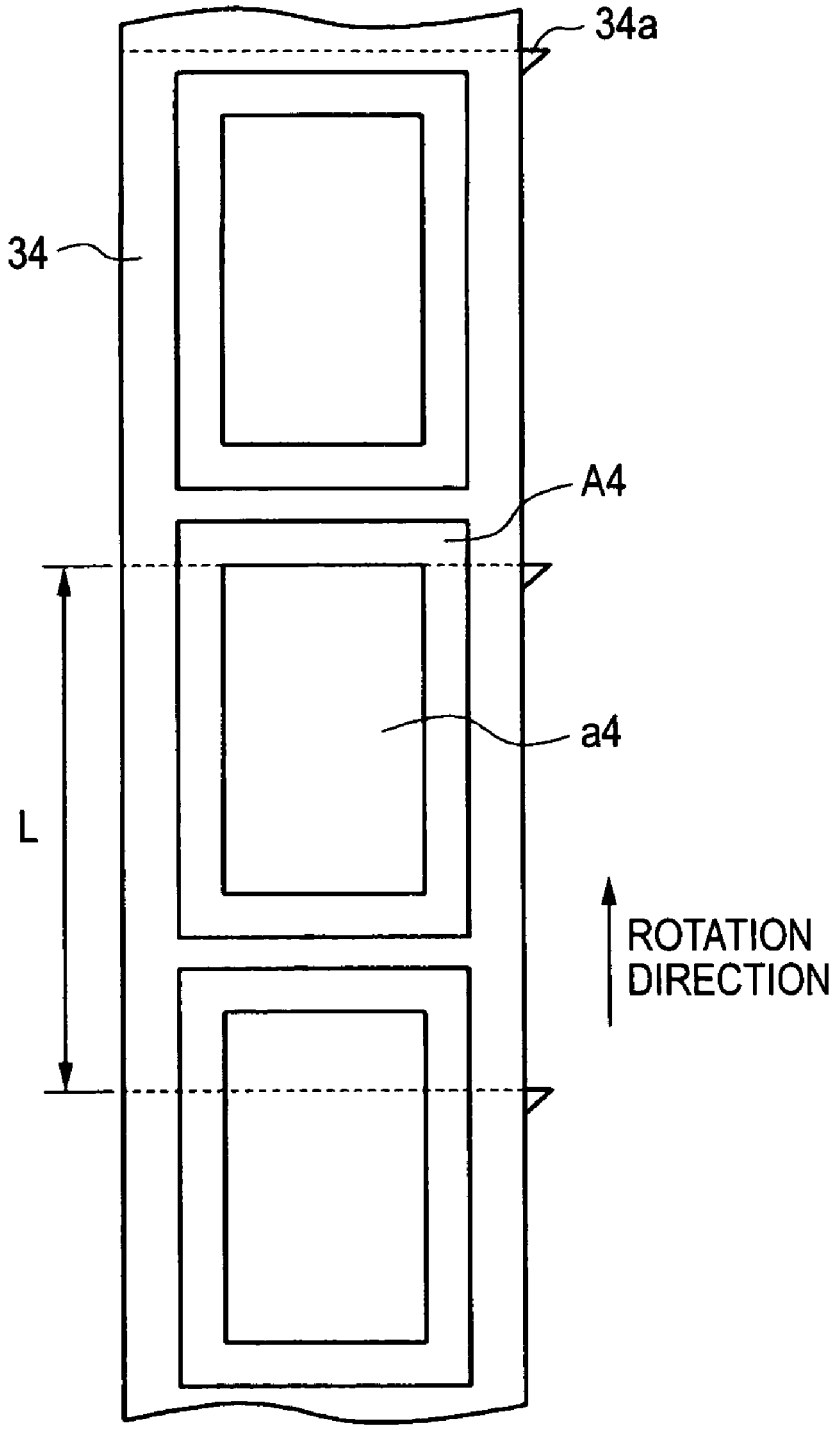
FIG. 11 is a developed plan view showing the case of shifting the toner image forming position on the intermediate transfer belt to a rotation-direction upstream side according to the sixth embodiment.

When the developing cartridges 37*k* are not to be switched for each development, image formation can also be provided as follows based on the shims 34*a* (other bases may be adopted, e.g., the rotation of the photoreceptor drum 32*a* may be used as the base). That is, for example, as shown in FIG. 11, a toner image forming position (carrying position) on the intermediate transfer belt 34 is shifted downstream with respect to the direction of rotation of the intermediate transfer belt 34. Thereby, in the case of a monochrome image, a toner image is carried even in the region between adjacent papers T of the intermediate transfer belt 34 and transferred to the recording paper A4, thus also enabling image formation.

Consequently, when being utilized as an apparatus for exclusive use in forming a monochrome image by attaching the four developing cartridges 37*k* to the developing rotary unit 33, this image forming apparatus is configured to carry out image forming control for optimally performing the timing of switching the developing cartridges 37*k* and the toner image forming position on the intermediate transfer belt 34, in response to image forming job information to be executed. That is, as with the color image, the monochrome image can be successively formed by performing image forming control for switching the developing cartridges 37*k* for each rotation of the intermediate transfer belt 34 (for each recording paper). Otherwise, in response to the image forming job information to be executed, the monochrome image can be successively formed by reducing the frequency of switching the developing cartridges 37*k* at the timing of requiring the adjusting operation of agitating and replenishing the stored toner and also by performing image forming control for forming the toner image a4 even in the region between adjacent papers T on the intermediate transfer belt 34.

Specifically, the CPU 13 of the engine controller 12 is configured to, after power on, carries out various control operations in accordance with the control program in the ROM 14. Thus, upon power on or replacement of the developing cartridges 37, the CPU 13 performs the noncontact communication routed through the connectors 43 and 44 and thereby holds (stores) in the main memory 15 the presence/absence of the developing cartridges 37 within the housing positions of the developing rotary unit 33. Besides, this CPU 13 sequentially reads the variety of information written in the nonvolatile memories 42 of the developing cartridges 37 via the connectors 43 and 44 and holds in the main memory 15 the position information per developing cartridge 37, the color information and consumption (remaining amount) of toner, etc. Furthermore, during the image forming operation or after the end of image formation, this CPU 13 writes and rewrites the variety of information, such as an amount of toner consumed by the image formation, to the nonvolatile memories 42 of the developing cartridges 37 via the connectors 43 and 44.

On this occasion, when knowing that the developing cartridges 37*y*, 37*m*, 37*c*, and 37*k* storing therein the color toners of yellow (Y), cyan (C), magenta (M), and black (K) are placed in the developing rotary unit 33, the CPU 13 performs general image forming control to rotate the developing rotary unit 33 in response to image data transmitted from the controller 11, thereby recording and forming a color image or a monochrome image on one or both sides of recording paper. In other words, each time upon receiving an instruction to print the image data, the developing cartridges 37 of the individual color toners attached to the developing rotary unit 33 operate as being appropriately switched in response to the kind of images based on the image data. Thereby, in the developing cartridges 37*y*, 37*m*, 37*c*, and 37*k*, the supply rollers 37*d* for supplying the stored toners to the developing rollers 37*d* are also supplied with the stored toners as the developing rotary unit 33 rotates.

On the other hand, when grasping the image forming apparatus is utilized as an apparatus for exclusive use in forming a monochrome image with the four developing cartridges 37*k* storing the toner of black (K) therein attached to the developing rotary unit 33, the CPU 13 carries out image forming control corresponding to image forming job information for recording and forming the received image data. That is, based on the image forming job information, the CPU 13 carries out image forming control for selecting and setting the toner image forming position on the intermediate transfer belt 34 and the timing of switching the developing cartridges 37*k*, thereby recording and forming the monochrome image, corresponding to the image data transmitted from the controller 11, on one or both sides of recording paper. Additionally, in the case of image forming job information for recording and forming image data on both sides of recording paper, the developing cartridges 37*k* can be switched within a recording paper inverting period in which the photoreceptor drum 32*a* and intermediate transfer belt 34 are stopped in synchronism with each other. Therefore, a speed at which to complete image formation, i.e., a so-called throughput will not vary significantly according to whether or not the developing cartridges 37*k* are switched for each recording paper. Consequently, a description will hereinafter be given of image forming job information for recording and forming image data on one side of recording paper.

Here, in the main memory 15 of the engine controller 12, the kind of images and various parameters are pre-set as criteria of determination by which the toner image forming position on the intermediate transfer belt 34 and the timing of switching the developing cartridges 37*k* are selected in response to the image forming job information. The kind of images indicates whether the image is a color image or a monochrome image, and the various parameters relates to the size (length) of recording paper on which to record and form image data and the number of recording papers on which to print the image data. Thus, the CPU 13 uses the various parameters of the image forming job information to select and set the toner image forming position on the intermediate transfer belt 34 and the timing of switching the developing cartridges 37*k*.

For example, as a parameter used in forming a monochrome image on one side of A4 size recording paper, various data such as follows are set in the main memory 15. In the case of an apparatus for exclusive use of this monochrome image, the timing of switching the developing cartridges 37*k* is not selected in response to whether the received image data is of color image or of monochrome image.

Figure 12:
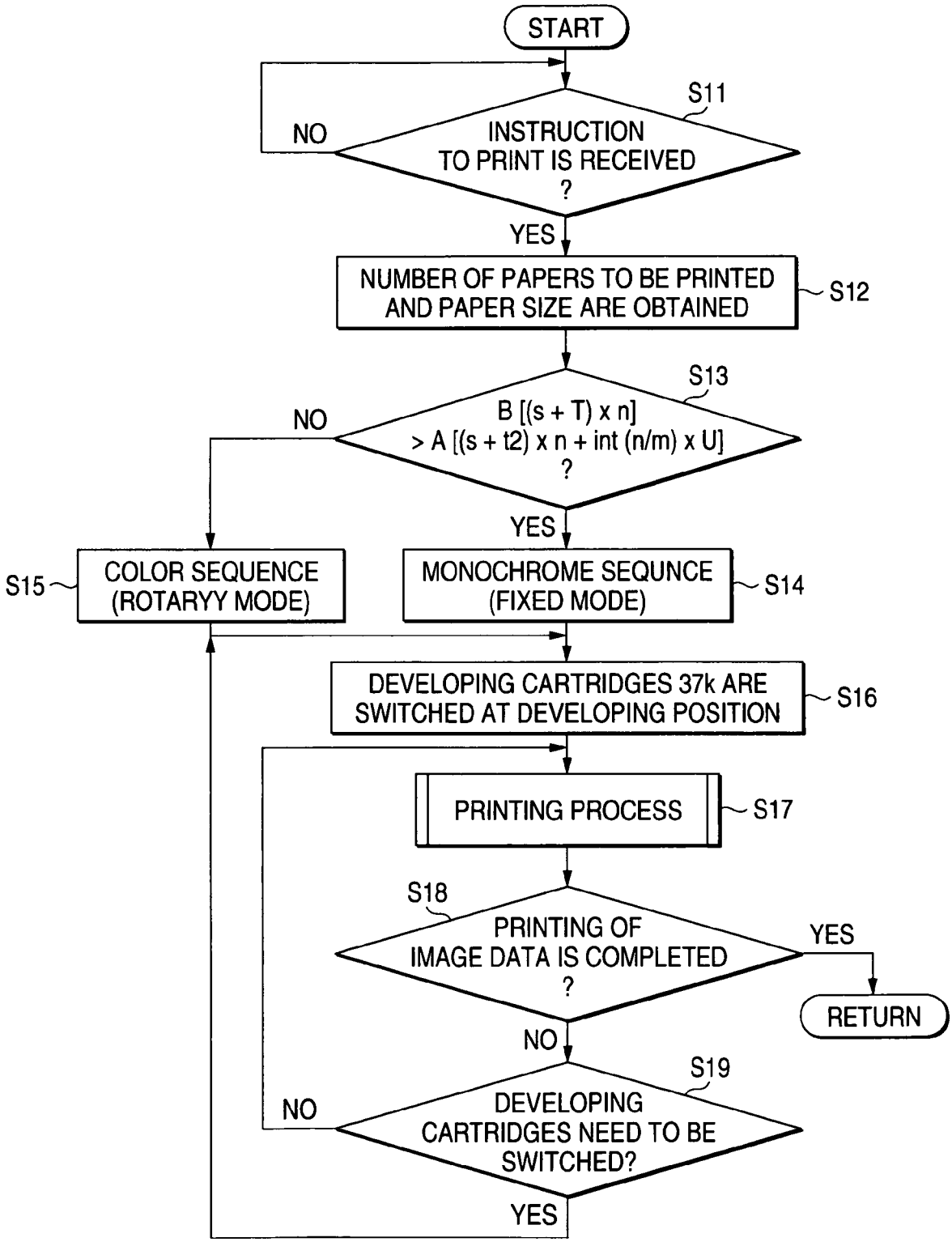
FIG. 12 is a flowchart illustrating image forming control according to the sixth embodiment.

A time required to provide image formation to A4 size recording paper (so-called process speed): s=1.8 seconds A time required to move the intermediate transfer belt 34 at a distance between adjacent papers thereon: T=0.4 seconds A time required to perform a switching operation of a developing cartridge (90° revolution) within the time for the distance between adjacent papers T: t1=0.2 seconds A preparation time for the distance between adjacent papers when the developing cartridges 37*k* are not switched: t2=0.2 seconds A stored toner adjusting operation time required to rotate the developing rotary unit through one revolution: U=5 seconds The timing of requiring the stored toner adjusting operation (image formation cycle): m=15 papers As shown in the flowchart of FIG. 12, the CPU 13 receives from the controller 11 an instruction to print image data of a monochrome image (Step S11). Then, the CPU 13 obtains the image forming time s corresponding to the size of recording paper on which to print the image data and the number n of recording papers on which to print the image data (Step S12). Thus, the CPU 13 uses the following expression to compare a time (Expression A) required for a printing process A and a time (Expression B) required for a printing process B and determine which printing process can complete image formation earlier (Step S13). The printing process A is for successively forming a monochrome image on the recording paper by shifting the toner image forming position on the intermediate transfer belt 34, to the upstream side, with the developing cartridge 37*k* remaining positioned at the developing position opposed to the photoreceptor drum 32*a*. The printing process B is for successively forming a monochrome image while switching the developing cartridges 37*k* to be set at the developing position for each recording paper, as with the color image.

$$B[(s+T)\times n]>A[(s+t2)\times N+int(n/m)\times U],$$

wherein int means that the quotient is converted to an integer.

From this comparison result, when the printing process A takes less time, with the developing cartridge 37*k* remaining fixed to the developing position without rotating the developing rotary unit, the CPU 13 selects and sets a monochrome sequence of fixed mode for successively forming the monochrome image by shifting the toner image forming position on the intermediate transfer belt 34, to the upstream side, so as to omit the region between adjacent papers T in the period of switching the aforesaid developing cartridge 37*k* (Step S14). On the contrary, when the printing process B takes less time, as with the color image formation, the CPU 13 selects and sets a color sequence of rotary mode for successively forming the monochrome image while switching the developing cartridges 37*k* by rotating the developing rotary unit 33 through an angle of 90° for each recording paper (Step S15).

Thereafter, before starting the printing process, the CPU 13 rotates the developing rotary unit 33 and switches the developing cartridges 37*k* so that the adjusted developing cartridge 37*k* having the stored toner agitated and replenished is moved to the developing position opposed to the photoreceptor drum 32*a* (Step S12). Thereafter, in accordance with the selection and setting of the monochrome sequence or color sequence, the CPU 13 starts driving control over the paper transport device 20 and image recording device 30 for printing the received image data, thus forming the monochrome image on one side of the recording paper (Step S17).

Subsequently, the CPU 13 determines whether or not the process of printing the received data is completed for each recording paper of this printing process (Step S18). When the printing process is completed, the CPU 13 puts this image forming control to an end accordingly, while when the printing process is not completed, the CPU 13 determines the necessity of switching the developing cartridges 37*k* (Step S19).

From this determination result, when the color sequence for providing image formation while switching the developing cartridges 37*k* is selected, or when the monochrome sequence is selected and the adjustment, etc. of agitating and replenishing the stored toner of the developing cartridge 37*k* fixed to the developing position exceed a necessary amount of image formation, the CPU 13 determines that the aforesaid developing cartridge 37*k* is required to be switched and returns to Step S16. Then, the CPU 13 rotates the developing rotary unit 33 to perform the switching operation of moving the next developing cartridge 37*k* to the developing position and, thereafter, carries on the process of printing the remaining image data.

On the contrary, when the monochrome sequence is selected and the adjustment of agitating and replenishing the stored toner of the developing cartridge 37*k* in use is not beyond the necessary amount of image formation, the CPU 13 returns to Step S17 and carries on the printing process using the same developing cartridge 37*k* without rotating the developing rotary unit 33.

Accordingly, the printing process can be rapidly completed by selecting, based on the size and number of recording papers on which to record and form the received image data, the color sequence for successively forming the monochrome image while switching the developing cartridges 37 to be set at the developing position, or the monochrome sequence for successively forming the monochrome image with the developing cartridge 37*k* fixed to the developing position as long as possible while shifting to the upstream side the toner forming position on the intermediate transfer belt 34.

Specifically, for example, when the monochrome image is successively formed on 10 to 1000 recording papers, the following selection result is obtained by making a comparison using the monochrome sequence (Expression A) and the color sequence (Expression B).

10 papers: Expression A=20 seconds, Expression B=22 seconds, using the monochrome sequence;

20 papers: Expression A=45 seconds, Expression B=44 seconds, using the color sequence;

30 papers: Expression A=65 seconds, Expression B=66 seconds, using the monochrome sequence;

40 papers: Expression A=90 seconds, Expression B=88 seconds, using the color sequence; and 100 papers: Expression A=230 seconds, Expression B=220 seconds, using the color sequence.

Thus, in this embodiment, when the image forming apparatus is used as an apparatus for exclusive use in forming a monochrome image by attaching thereto the four developing cartridges 37*k* storing the toner of black (K) therein, image formation can be provided by effectively utilizing the length of the intermediate transfer belt 34. And, image formation can be efficiently performed by selecting the color sequence or the monochrome sequence in response to the size of recording paper on which to record and from the received image data and the number of recording papers on which to print the image data. Accordingly, it is possible to improve a speed at which to complete image formation (so-called throughput).

Here, this embodiment describes, as an example, the case in which the image forming apparatus is used as an apparatus for exclusive use in forming a monochrome image by attaching the four developing cartridges to the developing rotatory unit 33. However, the invention is not limited thereto but is also applicable to the case in which the image forming apparatus is used capable of forming a color image. Specifically, upon receipt of image data for forming a monochrome image, the toner image forming position on the intermediate transfer belt 34 is shifted toward the upstream side, thus also enabling rapid completion of recording and forming of the image data. In this case, needless to say, a device (e.g., agitator device or auger device) for performing the adjusting operation of agitating and replenishing the stored toner may be provided in the developing cartridge 37*k*.

Besides, this embodiment describes, as an example, the case of providing image formation to A4 size recording paper. However, the invention is not limited thereto. For example, in the case of providing image formation to B5 size recording paper, the position of the toner image a4 to be transferred to and formed on the intermediate transfer belt 34 is shifted further to the rotation-direction upstream side, thus enabling rapider completion of recording and forming of the image data.

Furthermore, in this embodiment, the case of rotating the developing rotary unit through one revolution is described as the adjusting operation of agitating and replenishing the stored toner in the developing cartridge 37*k* using the monochrome sequence. However, the invention is not limited thereto. For example, needless to say, the adjusting operation may be performed by rotating the developing rotary unit 33 through an angle of 90° or more.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2004-078276 filed on Mar. 18, 2004, Japan Patent Application No. 2004-078277 filed on Mar. 18, 2004 and Japan Patent Application No. 2004-078278 filed on Mar. 18, 2004, the contents of which are incorporated herein for reference.

What is claimed is:

1. An image forming apparatus, comprising:

a carrier on which an electrostatic latent image is formed;

a plurality of development cartridges which develop the electrostatic latent image with toner to form a toner image;

a rotary unit on which the developing cartridges are mounted around a rotational shaft of the rotary unit, and which rotates the developing cartridges about the rotational shaft so as to oppose any of the developing cartridges to the carrier; and a controller which controls a rotation of the rotary unit for switching the developing cartridges and a driving of the developing cartridges to form the toner image, wherein:

the controller adjusts the toner stored in the developing cartridge for successively forming the image so as to invert the developing cartridges upside down by rotating the rotary unit based on image forming job information for executing an image formation;

the image forming job information includes at least a job toner consumption amount required to execute the image forming job;

the image forming job information includes a consumption amount of the toner stored in the developing cartridge which is positioned at a developing position opposed to the carrier;

a margin consumption amount and a limit consumption amount are set;

the limit consumption amount indicates that a toner amount stored in the developing cartridge is near end amount;

the margin consumption amount indicates that the toner amount stored in the developing cartridge is a toner amount in which a little margin toner amount is added to the limit consumption amount; and when the job toner consumption amount is smaller than the limit consumption amount even when the job toner consumption amount exceeds the margin consumption amount, the controller completes the image forming job without performing an operation of adjusting the toner stored in the developing cartridge.

2. The image forming apparatus as set forth in claim 1, wherein the development cartridges storing different color toners for forming a color image, a multicolor image, or a monochrome image are mounted on the rotary unit; and wherein the controller rotates the rotary unit for one revolution to perform the operation of adjusting the toner stored in the developing cartridge in the monochrome image formation.

3. The image forming apparatus as set forth in claim 1, wherein the development cartridges storing the same color toners for forming a monochrome image are mounted on the rotary unit; and wherein the controller performs the operation of adjusting the toner stored in the developing cartridge to be used in successively forming the monochrome image without rotating the rotary unit, by rotating the rotary unit through an angle equal to or greater than an angle required to switch from the developing cartridge positioned at a developing position opposed to the carrier to another developing cartridge adjacent thereto.

* * * * *